US009318091B2

(12) United States Patent
Takeda et al.

(10) Patent No.: US 9,318,091 B2
(45) Date of Patent: Apr. 19, 2016

(54) AIR CONDITIONER

(75) Inventors: Yasukata Takeda, Osaka (JP); Masaki Ohtsuka, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 885 days.

(21) Appl. No.: 13/393,469

(22) PCT Filed: Jul. 9, 2010

(86) PCT No.: PCT/JP2010/061685

§ 371 (c)(1),
(2), (4) Date: Feb. 29, 2012

(87) PCT Pub. No.: WO2011/030612

PCT Pub. Date: Mar. 17, 2011

(65) Prior Publication Data

US 2012/0171947 A1 Jul. 5, 2012

(30) Foreign Application Priority Data

Sep. 14, 2009 (JP) ..... 2009-211759

(51) Int. Cl.

| | |
|---|---|
| ***F24F 7/00*** | (2006.01) |
| ***G10K 11/178*** | (2006.01) |
| ***F24F 1/00*** | (2011.01) |
| ***F24F 13/24*** | (2006.01) |

(52) U.S. Cl.

CPC ..... *G10K 11/178* (2013.01); *F24F 1/0007* (2013.01); *F24F 13/24* (2013.01); *F24F 2013/247* (2013.01); *G10K 2210/104* (2013.01); *G10K 2210/112* (2013.01)

(58) Field of Classification Search

USPC ..... 454/251, 290, 184; 361/690
IPC F24F 1/0007,13/24; G06F 1/206, 1/181; H05K 7/20127

See application file for complete search history.

(56) References Cited

FOREIGN PATENT DOCUMENTS

| | | | | |
|---|---|---|---|---|
| JP | 63-140897 | A | | 6/1988 |
| JP | 2-115510 | A | | 4/1990 |
| JP | 2-165797 | A | | 6/1990 |
| JP | 4-281125 | A | | 10/1992 |
| JP | 5-001914 | U | | 1/1993 |
| JP | 6-043884 | A | | 2/1994 |
| JP | 7-160276 | A | | 6/1995 |
| JP | 8-200780 | A | | 8/1996 |
| JP | 9-184499 | A | | 7/1997 |
| JP | 2004-353914 | A | | 12/2004 |
| JP | 2005-037447 | A | | 2/2005 |
| JP | 2005-164063 | A | * | 6/2005 |
| JP | 2005-164063 | A | | 6/2005 |
| JP | 2005-201565 | A | | 7/2005 |

* cited by examiner

*Primary Examiner* — Steven B McAllister
*Assistant Examiner* — Helena Kosanovic
(74) *Attorney, Agent, or Firm* — Birch, Stewart, Kolasch & Birch, LLP

(57) ABSTRACT

In an air conditioner, an air flow guide panel (20) and a speaker (21) are provided in a vicinity of an outlet (5). The air flow guide panel (20) is operable to form a duct-like outlet passage (10) in the vicinity of the outlet (5), and, in the duct-like outlet passage (10), a speaker (21) radiates a sound wave for canceling out operation noise including blower sound of a fan (7).

6 Claims, 20 Drawing Sheets

FIG. 5A THE PRESENT INVENTION
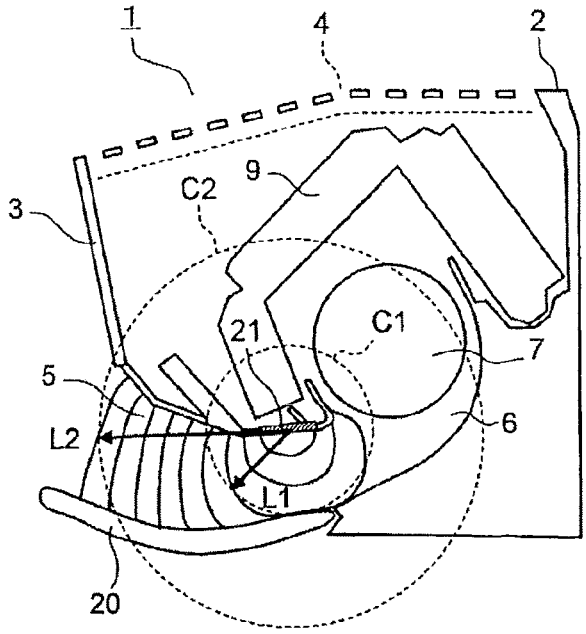
FIG. 5B PRIOR ART
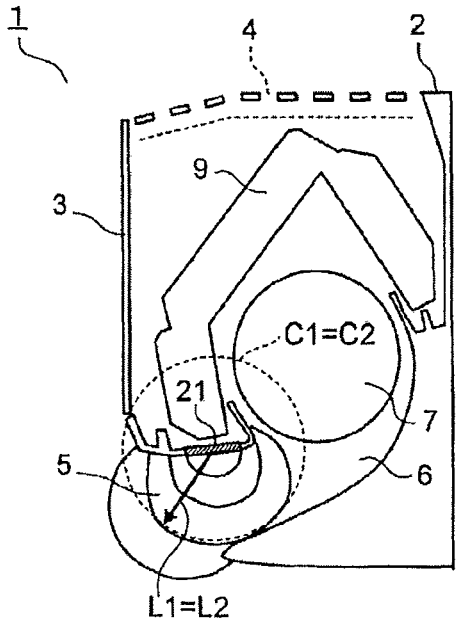

FIG. 6A THE PRESENT INVENTION
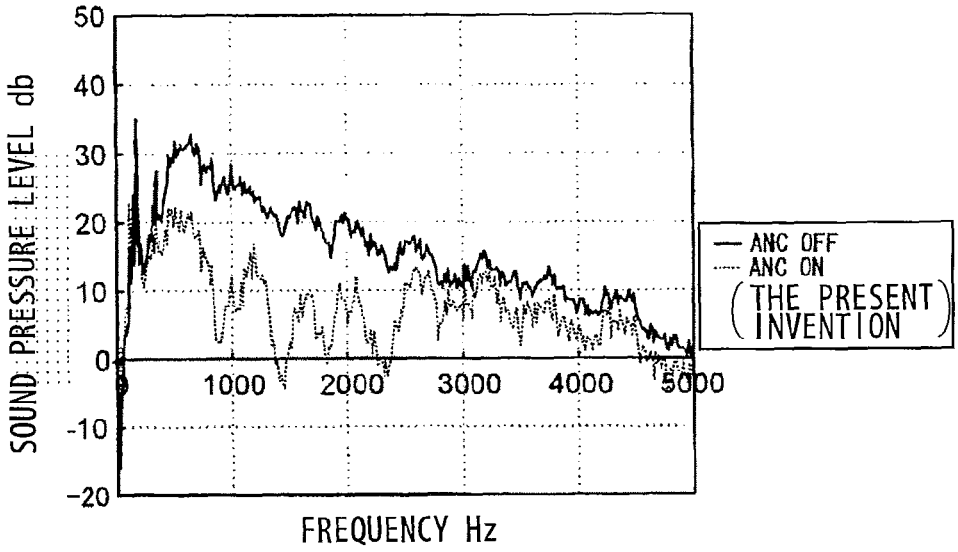
FIG. 6B PRIOR ART
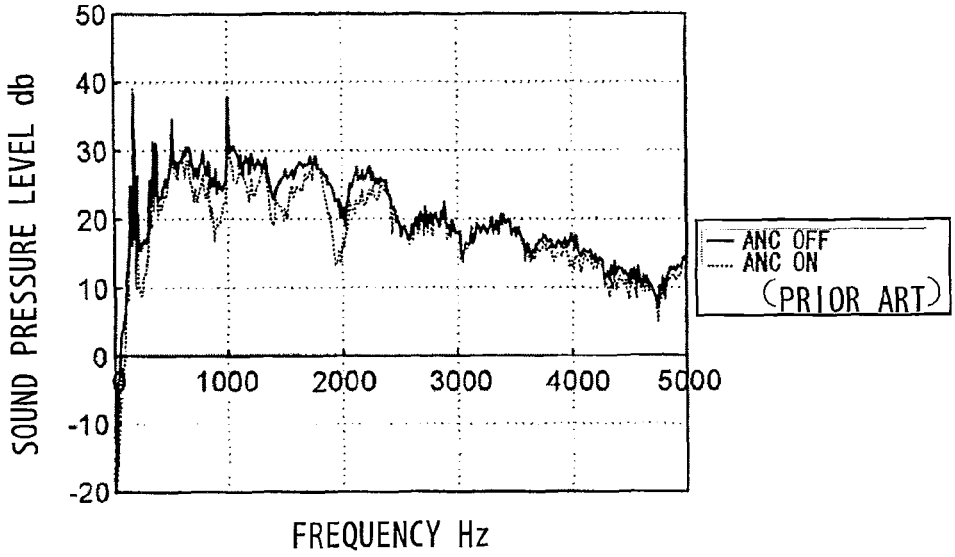

AIR CONDITIONER

TECHNICAL FIELD

The present invention relates to an air conditioner, and more specifically, to an air conditioner capable of reducing noise during operation, such as blower sound.

BACKGROUND ART

Conventionally, in order to reduce noise of an air conditioner during operation, such as blower sound, it has been proposed to include an active noise control mechanism (also called active noise cancellation) for superimposing a canceling sound wave which is in antiphase to noise to cancel the noise.

For example, in Patent Literature 1, a microphone and a flat plate speaker are placed in a predetermined space within an indoor unit of an air conditioner, and the flat plate speaker radiates a sound wave having substantially the same frequency and substantially the same sound pressure level as, and being in substantially antiphase to, noise at a specific frequency detected by the microphone, to thereby perform noise cancellation effectively.

Further, Patent Literature 2 discloses a technology in which operation sound detecting means, reference operation sound setting means, and correction sound emitting means are provided and, when a temporal fluctuation amount of operation sound is larger than a predetermined level, the correction sound emitting means compares the operation sound to a reference operation sound set by the reference operation sound setting means, and radiates a correction sound so that a combined sound obtained when the correction sound is combined with the operation sound becomes the reference operation sound.

Still further, Patent Literature 3 discloses a technology in which a plurality of microphones, controllers, and speakers are provided to constitute independent control systems, respectively, and the microphones and the speakers are disposed at predetermined intervals along an axial direction of a transverse fan.

CITATION LIST

Patent Literatures

PTL 1: JP 63-140897 A
PTL 2: JP 6-43884 A
PTL 3: JP 2005-201565 A

SUMMARY OF INVENTION

Technical Problem

In active noise cancellation, a sound wave (noise) traveling through a closed space, such as a duct, which is a one-dimensional sound field (sound field in which the spread of sound is restricted in one direction), is similar to a plane wave, and hence the noise can be canceled well by an antiphase sound wave radiated from a cancellation sound source, and noise cancellation can be performed effectively. However, in a three-dimensional sound field (sound field in which sound spreads in random directions) such as free space propagation, the sound wave is a spherical wave. Thus, there occur a region in which the noise is overcome by an antiphase sound wave and a region in which the noise level contrarily increases because of in-phase sound waves. It is therefore impossible for the current technologies to achieve noise cancellation on a practical level.

As for noise cancellation of blower noise, an air conditioning duct apparatus has a duct as a blower passage, which can be a one-dimensional sound field, and hence it is possible to apply active noise cancellation relatively easily. However, in an air conditioner to be used so that an indoor unit is mounted on an indoor wall surface, there is no blower passage regarded as a one-dimensional sound field, and hence, even if a cancellation sound source is provided in a blower passage, just as in the case where active noise cancellation is performed in a three-dimensional sound field as described above, it sounds rather noisy depending on the place in the room. This is not practical at all. In fact, various technologies of reducing operation noise have been studied as exemplified by Patent Literatures 1 to 3, but there are no cases where those technologies are put into practical use. In other words, it is understood that effective noise cancellation of blower noise needs a portion which can be a one-dimensional sound field having a certain length in a blower passage, especially on the downstream side of blower means.

In view of the above-mentioned problem, it is therefore an object of the present invention to obtain a sufficient noise canceling effect in a wall-mounted air conditioner.

Solution to Problem

In order to achieve the above-mentioned object, according to the present invention, there is provided an air conditioner to be used by being mounted on an indoor wall surface, including: a casing; an inlet provided to the casing, for introducing air in a room; an outlet provided to the casing, for delivering conditioned air, which is obtained by conditioning air introduced from the inlet, to the room; blower means for moving air from the inlet to the outlet; a blower passage communicating between the inlet and the outlet; and air flow direction changing means and sound emitting means, which are provided in a vicinity of the outlet, in which the air flow direction changing means is operable to form a duct-like outlet passage in the vicinity of the outlet, and, in the duct-like outlet passage, the sound emitting means radiates a sound wave for canceling out operation noise including blower sound of the blower means.

According to this configuration, the duct-like outlet passage, which can be a one-dimensional sound field, is formed in the vicinity of the outlet located on the downstream side of the blower means in the blower passage. Then, in this duct-like outlet passage, the sound wave for canceling out the operation noise including the blower sound of the blower means is radiated from the sound emitting means. Therefore, the operation noise is efficiently canceled out while passing through the duct-like outlet passage. With this, the noise to be radiated into the room can be reliably reduced, and a sufficient noise canceling effect can be obtained.

Further, in the air conditioner of the present invention having the above-mentioned configuration, the air flow direction changing means may include an air flow guide panel, which is vertically pivotable for opening and closing the outlet, and when the duct-like outlet passage is to be formed, the air flow guide panel may pivot so as to be open upward and may be disposed so as to extend a lower surface of the blower passage while covering over the outlet.

According to this configuration, the inner surface of the air flow guide panel, the upper surface, the lower surface, and the left and right side surfaces of the blower passage, and a part of the front surface of the casing together form the duct-like outlet passage for delivering air toward the ceiling of the room, and further, the air flow guide panel covers the outlet. With this, there are obtained effects that the blower sound of the blower means is less likely to diffuse and that the air flow guide panel insulates the noise to be radiated into the room, which can contribute to the reduction of noise.

Further, in the air conditioner of the present invention having the above-mentioned configuration, the air flow direction changing means may include an air flow guide panel, which is vertically pivotable for opening and closing the outlet, and when the duct-like outlet passage is to be formed, the air flow guide panel may pivot so as to be open downward and may be disposed so as to extend an upper surface of the blower passage while covering over the outlet.

According to this configuration, the inner surface of the air flow guide panel, the upper surface, the lower surface, and the left and right side surfaces of the blower passage, and a part of the lower surface of the casing together form the duct-like outlet passage for delivering air toward the floor of the room, and further, the air flow guide panel covers the outlet. With this, there are obtained effects that the blower sound of the blower means is less likely to diffuse and that the air flow guide panel insulates the noise to be radiated from the outlet, which can contribute to the reduction of noise. When the air conditioner further includes the auxiliary panel, which is disposed so as to extend the lower surface of the blower passage when the duct-like outlet passage is to be formed, the duct-like outlet passage having a sufficient length can be reliably formed.

Note that, in order that a closed space through which sound can travel as a plane wave be formed in the vicinity of the outlet, the length of the air flow guide panel in the blower direction needs to be at least more than the height of the outlet at the position at which the sound emitting means is installed.

Further, the air conditioner of the present invention having the above-mentioned configuration may further include reference sound detecting means for detecting a sound wave of the operation noise, in which the sound emitting means may radiate a sound wave in antiphase to the sound wave detected by the reference sound detecting means.

According to this configuration, it is possible to detect sound which is actually generated when the blower means is driven and to radiate a canceling sound wave against the actually generated sound. Thus, the accuracy of the active noise cancellation can be increased. In this case, it is desired to dispose the reference sound detecting means on the upstream side of the sound emitting means in the duct-like outlet passage so as not to detect a sound wave radiated from the sound emitting means, which is not a detection target of the reference detecting means.

Further, the air conditioner of the present invention having the above-mentioned configuration may further include correction sound detecting means for detecting a noise level after the operation noise is canceled out, in which the sound wave to be radiated from the sound emitting means may be corrected so that the noise level detected by the correction sound detecting means falls within a predetermined range.

According to this configuration, the accuracy of the active noise cancellation can be increased more by feedback control of the noise level after cancellation. In this case, it is desired to dispose the correction sound detecting means on the downstream side of the sound emitting means in the duct-like outlet passage so as not to detect operation noise, which is not a detection target of the correction detecting means.

Further, the air conditioner of the present invention having the above-mentioned configuration may further include a plurality of vertical louvers in the outlet, in which a plurality of the sound emitting means may be disposed for respective sections divided by the plurality of vertical louvers.

According to this configuration, the blower passage can be divided into small sections, and hence the blower sound of the blower means is even less likely to diffuse, and the noise canceling effect can be obtained satisfactorily. It is more desired that the width of the section be 85 mm or less. According to this configuration, the width of the section becomes equal to or less than about ½ of the wavelength of a sound wave of 2,000 Hz. Thus, a sound wave passing through the section can be regarded as a substantially plane wave, that is, the inside of the section can be regarded as a one-dimensional sound field. In particular, a sufficient noise canceling effect can be obtained in a low frequency range of 2,000 Hz or less, where the active noise cancellation is targeted.

Further, the air conditioner of the present invention having the above-mentioned configuration may further include a plurality of vertical louvers in the outlet, in which a plurality of the sound emitting means and a plurality of the reference sound detecting means may be disposed for respective sections divided by the plurality of vertical louvers, thereby performing canceling control of the operation noise independently for each of the sections.

According to this configuration, canceling control against actually generated sound can be performed for each small sectioned space. Thus, the accuracy of the active noise cancellation can be increased. It is more desired that the width of the section be 85 mm or less. According to this configuration, the width of the section becomes equal to or less than about ½ of the wavelength of a sound wave of 2,000 Hz. Thus, a sound wave passing through the section can be regarded as a substantially plane wave, that is, the inside of the section can be regarded as a one-dimensional sound field. In particular, a sufficient noise canceling effect can be obtained in a low frequency range of 2,000 Hz or less, where the active noise cancellation is targeted.

Further, in the air conditioner of the present invention having the above-mentioned configuration, a plurality of the correction sound detecting means may each be disposed so that the sound emitting means is sandwiched between the reference sound detecting means and the correction sound detecting means in a blower direction.

According to this configuration, for example, the air flow guide panel pivots so as to be open upward in the case of cooling and so as to be open downward in the case of heating and is disposed so as to cover over the outlet. In either case of upward opening or downward opening, detection target sound can be detected satisfactorily by the sound detecting means which are disposed on both the upstream side and the downstream side of the sound emitting means.

Further, in the air conditioner of the present invention having the above-mentioned configuration, the sound emitting means may be disposed on the air flow guide panel. According to this configuration, the speaker faces the casing of the indoor unit, and hence, owing to the diffraction effect, a sound wave radiated from the speaker can be prevented from leaking into the room. Thus, the noise canceling effect is increased more.

Further, in the above-mentioned configuration of the present invention, the correction sound detecting means, the correction sound detecting means, and the reference sound detecting means may be disposed on the air flow direction changing means so that the sound emitting means is sandwiched between the correction sound detecting means and the reference sound detecting means in a blower direction, and the correction sound detecting means and the reference sound detecting means may be configured to be switchable.

According to this configuration, for example, the air flow direction changing means may pivot so as to be open upward in the case of cooling and so as to be open downward in the case of heating and may be disposed so as to cover over the outlet. In either case of upward opening or downward opening, the reference sound detecting means and the correction sound detecting means may be disposed on the upstream side and the downstream side of the sound emitting means, respectively.

Advantageous Effects of Invention

According to the air conditioner of the present invention, the duct-like outlet passage, which can be a one-dimensional sound field, is formed in the vicinity of the outlet, and in this duct-like outlet passage, the operation noise including the blower sound of the blower means is subjected to active noise cancellation. Thus, the operation noise to be radiated into the room can be reliably reduced, and a sufficient noise canceling effect can be obtained.

BRIEF DESCRIPTION OF DRAWINGS

FIG. 5(*a*) is a schematic side cross-sectional view of the indoor unit illustrating the principle of operation noise control of the air conditioner according to the present invention, and FIG. 5(*b*) is a schematic side cross-sectional view of the indoor unit illustrating the principle of operation noise control of an air conditioner in the related art.

FIG. 6 are graphs showing a noise reduction effect obtained by the operation noise control of the air conditioner according to the present invention (FIG. 6(*a*)) in comparison with that of the air conditioner in the related art (FIG. 6(*b*)).

DESCRIPTION OF EMBODIMENTS

Hereinafter, embodiments of the present invention are described with reference to the drawings. In the embodiments of the present invention, a description is given of an example of a separate air conditioner including an indoor unit to be mounted on an indoor wall surface and an outdoor unit to be mounted outdoors for stationary use.

First Embodiment

Figure 1:
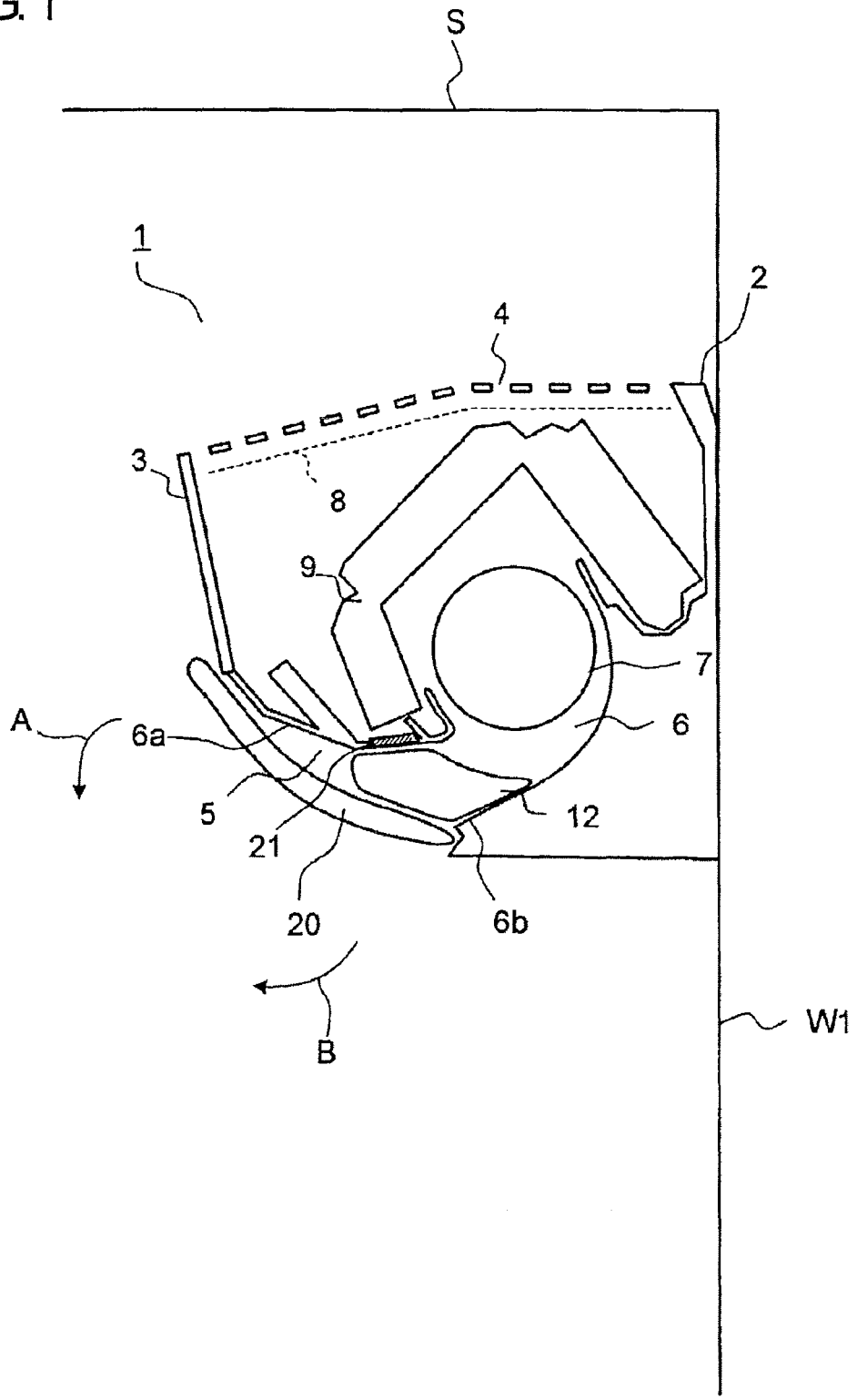
FIG. 1 is a schematic side cross-sectional view of an indoor unit illustrating an operation stop state of an air conditioner according to a first embodiment.
Figure 2:
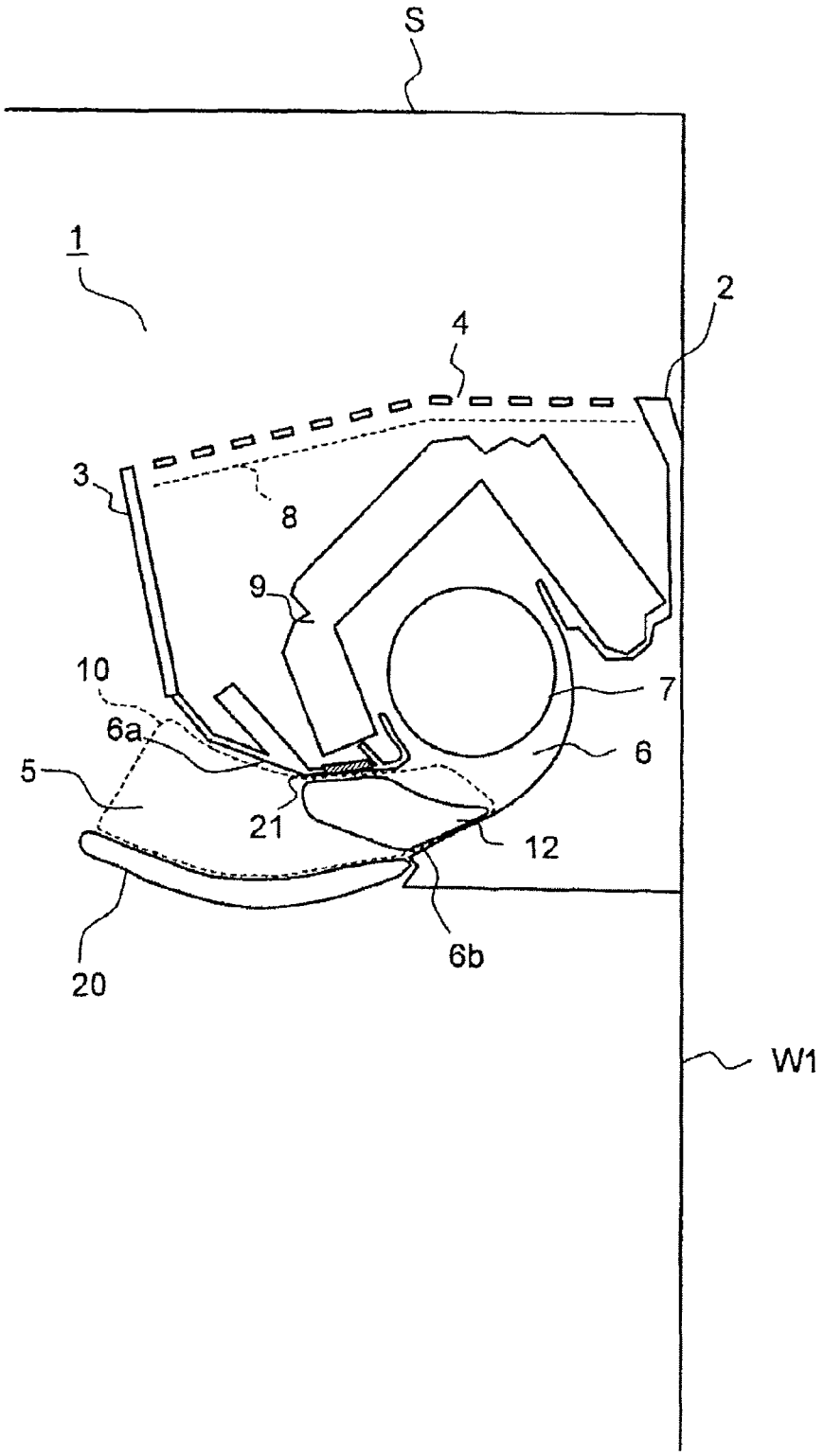
FIG. 2 is a schematic side cross-sectional view of the indoor unit illustrating an example of an operating state of the air conditioner according to the first embodiment.
Figure 3:
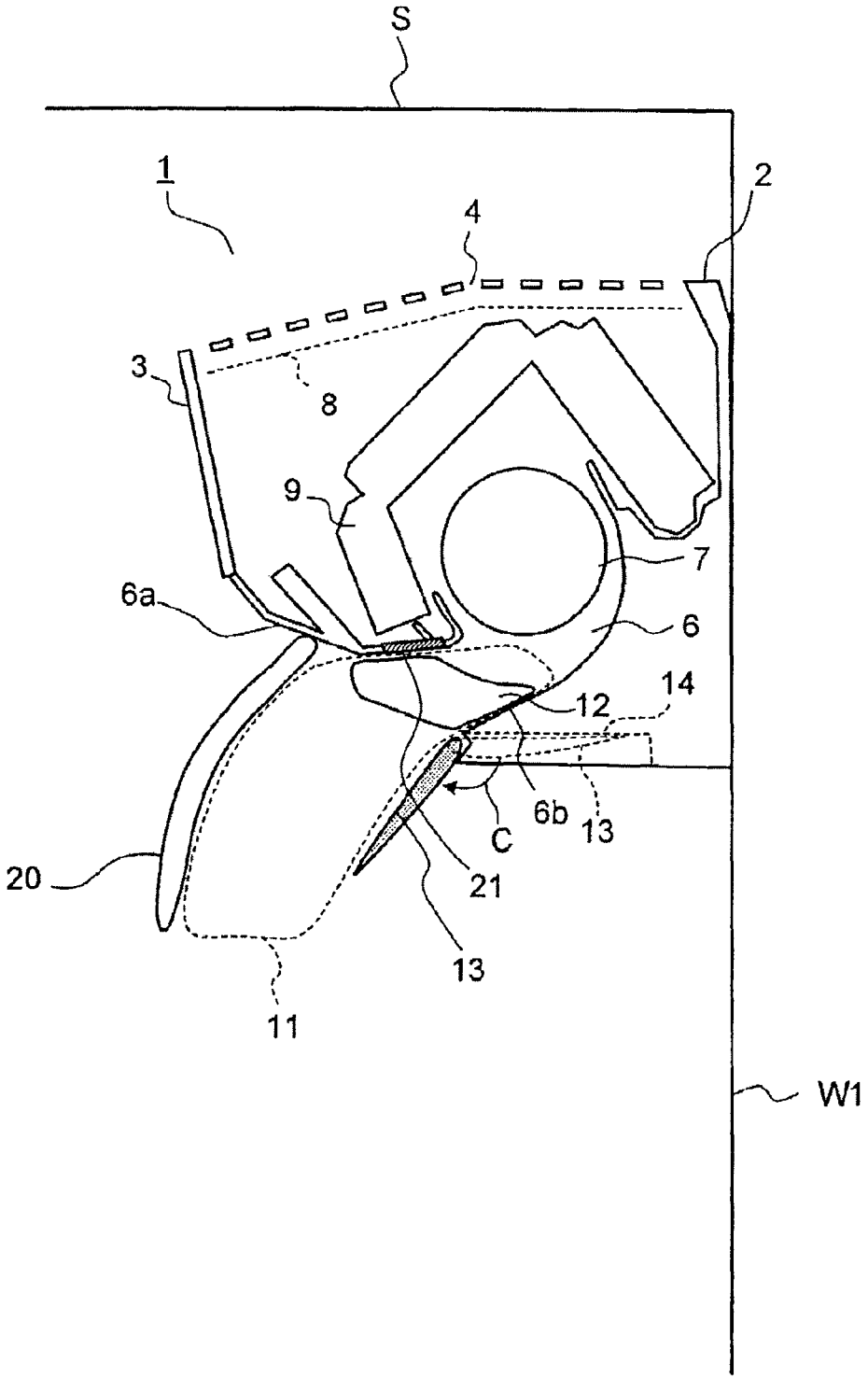
FIG. 3 is a schematic side cross-sectional view of the indoor unit illustrating another example of the operating state of the indoor unit of the air conditioner according to the first embodiment.

FIG. 1 is a schematic side cross-sectional view of an indoor unit illustrating an operation stop state of an air conditioner according to a first embodiment. FIG. 2 is a schematic side cross-sectional view of the indoor unit illustrating an example of an operating state of the air conditioner according to the first embodiment. FIG. 3 is a schematic side cross-sectional view of the indoor unit illustrating another example of the operating state of the indoor unit of the air conditioner according to the first embodiment.

As illustrated in FIGS. 1 to 3, a main body portion of an indoor unit 1 of the air conditioner is held by a cabinet 2, and a front panel 3 which is provided with an inlet 4 on the upper surface side thereof is removably attached to the cabinet 2. The cabinet 2 and the front panel 3 together constitute a casing of the indoor unit 1.

The cabinet 2 is provided with a claw portion (not shown) on a rear side surface thereof. The cabinet 2 is supported by a mounting plate (not shown) which is mounted on a side wall W1 of the room at a height position closer to a ceiling S in a manner that the claw portion is engaged with the mounting plate. An outlet 5 is provided in a gap between a lower end portion of the front panel 3 and a lower end portion of the cabinet 2. The outlet 5 is formed into a substantially rectangular shape extending in a width direction of the indoor unit 1, and is provided so as to face downward in the front.

Inside the indoor unit 1, a blower passage 6 communicating to the outlet 5 from the inlet 4 is formed. A fan 7 as blower means for delivering air is disposed in the blower passage 6. A fan to be suitably used as the fan 7 is a crossflow fan (transverse fan), but other types of fans may be used. In the blower passage 6, on the downstream side of the fan 7, there are formed an upper wall 6*a* and a lower wall 6*b* which guide the air delivered by the fan 7 downward in the front and whose cross-sectional area increases more on the downstream side. Note that, although not illustrated, the blower passage 6 also has left and right side walls which are flush with left and right side walls to which the fan 7 is pivotally supported.

On the upper wall 6*a* of the blower passage 6, a speaker 21 as sound emitting means is provided so as to face the blower passage 6. As the speaker 21, a small-footprint flat plate speaker is suitably used, but other types of speakers including a cylindrical speaker may be used. Alternatively, it is possible to use a speaker having the directivity in a blower direction.

In the vicinity of the outlet 5, an air flow guide panel 20 (vertical air flow direction changing means) which is pivotally supported to open and close the outlet 5 is provided.

In the operation stop state of the air conditioner, the air flow guide panel 20 is disposed at a position to close the outlet 5 as illustrated in FIG. 1. At this time, the panel 20 is disposed along a design shape of a front surface of the front panel 3, and is disposed so as to connect a lower end of the air flow guide panel 20 and a bottom surface of the cabinet 2 at the position of a lower end portion of the outlet 5. Therefore, the appearance of the indoor unit 1 is not impaired.

The air flow guide panel 20 is pivotally supported at two vertical positions by two upper and lower different shafts (not shown) so that a regulating portion (not shown) for regulating one of the two shafts as a pivot shaft while releasing the other shaft and a moving portion (not shown) for pivoting the air flow guide panel 20 about the pivot shaft may operate in a linked manner. For example, in cooling, the air flow guide panel 20 is pivoted counterclockwise as indicated by the arrow A of FIG. 1 so as to be open upward, and is disposed so as to extend a lower surface of the blower passage 6 while covering over the outlet 5 as illustrated in FIG. 2.

In this case, the inner surface of the air flow guide panel 20, the upper surface, the lower surface, and the left and right side surfaces of the blower passage 6, and a part of the front surface of the front panel 3 together form a duct-like outlet passage 10 for changing the direction of air flow upward and delivering air toward the ceiling of the room, and further, the air flow guide panel 20 covers the outlet 5 when the front panel 3 is viewed from the front (from the left of the sheet of FIG. 2). This prevents a person from being directly exposed to cold air, thereby realizing comfortable cooling with the air flow wrapping from the head of the person.

On the other hand, for example, in heating, the air flow guide panel 20 can also be pivoted so as to be open downward as indicated by the arrow B of FIG. 1, and be disposed so as to extend the upper surface of the blower passage 6 while covering over the outlet 5. In this case, as illustrated in FIG. 3, the inner surface of the air flow guide panel 20, the upper surface, the lower surface, and the left and right side surfaces of the blower passage 6, and a part of the lower surface of the front panel 3 together form a duct-like outlet passage 11 for changing the direction of air flow downward and delivering air toward the floor of the room, and further, the air flow guide panel 20 covers the outlet 5 when the front panel 3 is viewed from the front (from the left of the sheet of FIG. 3). This prevents a person from being directly exposed to warm air, thereby realizing comfortable heating with the air flow wrapping from the feet of the person.

Note that, in FIG. 3, reference numeral 13 denotes an auxiliary panel which is pivotally provided at a front end of the lower wall 6*b* of the blower passage 6. The auxiliary panel 13 is normally accommodated in, for example, a recess portion 14 which is recessed in the lower surface of the lower wall 6*b*. When the duct-like outlet passage 11 is to be formed, the auxiliary panel 13 is pivoted about a pivot shaft at the front end as indicated by the arrow C and is disposed so as to extend the lower surface of the blower passage 6. With this, the duct-like outlet passage 11 having a sufficient length can be reliably formed.

Note that, although not illustrated, the indoor unit 1 of the air conditioner according to the present invention may be configured so as to change the direction of air flow to the horizontal direction or the front downward direction through a combination of appropriate selection of the pivot shaft of the air flow guide panel 20 made by the regulating portion and appropriate setting of a pivot angle of the air flow guide panel 20 made by the moving portion.

Figure 4:
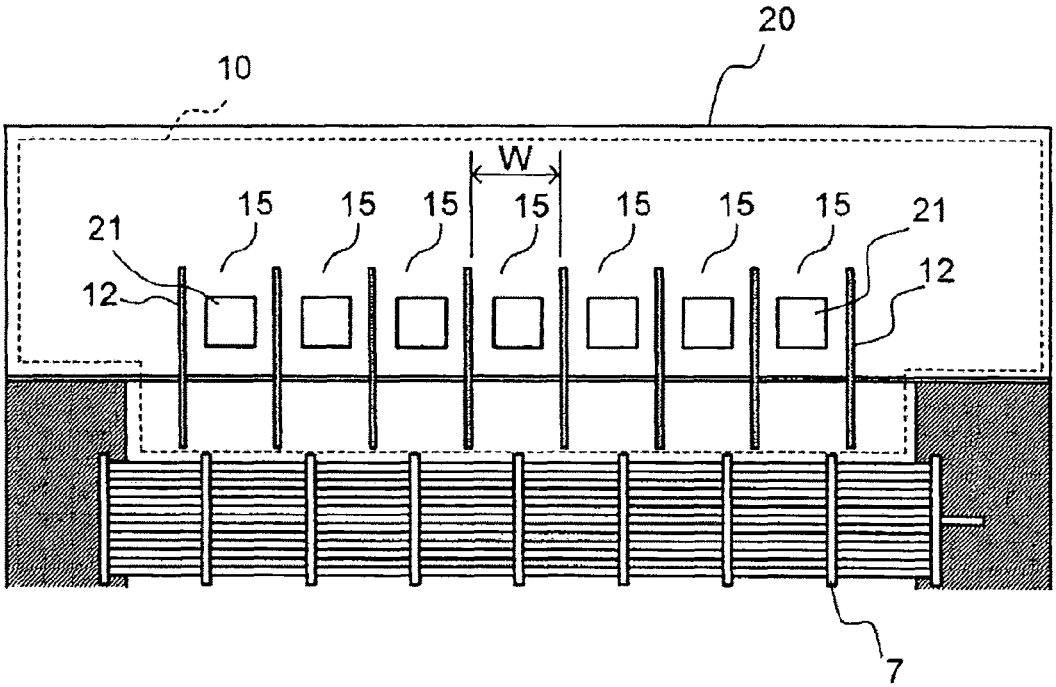
FIG. 4 is a schematic horizontal cross-sectional view illustrating the vicinity of an outlet of the indoor unit of the air conditioner according to the first embodiment.
Figure 20:
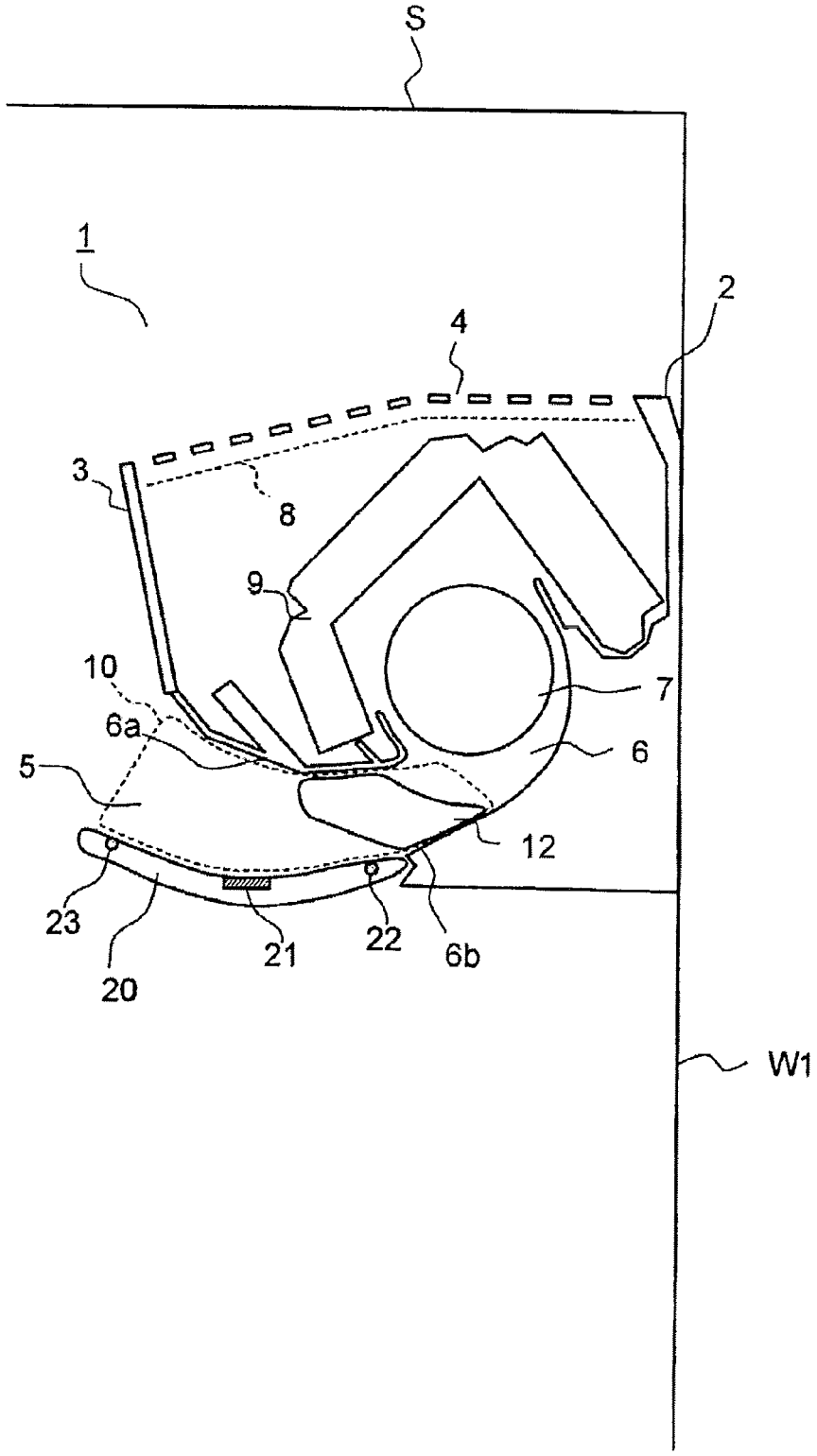
FIG. 20 is a schematic side cross-sectional view of an indoor unit illustrating an example of an operating state of an air conditioner according to a modified example of the third embodiment.

Further, in the outlet 5, as illustrated in FIG. 4 of a schematic horizontal cross-sectional view of the vicinity of the outlet, a plurality of vertical louvers (horizontal air flow direction changing means) 12 are pivotally provided side by side in the horizontal direction. With the plurality of vertical louvers 12, the above-mentioned duct-like outlet passages 10 and 11 are divided into a plurality of sections 15. Then, a plurality of the above-mentioned speakers 21 are disposed for the respective sections 15 divided by the vertical louvers 12. (FIG. 4 illustrates the speakers 21 as if those are disposed on the air flow guide panel 20, but, in this embodiment, the speakers 21 are disposed on the upper wall 6*a* of the blower passage 6 as illustrated in FIG. 3. FIG. 4 is a schematic horizontal cross-sectional view illustrating that the plurality of speakers 21 are disposed for the respective sections 15. Alternatively, however, as another embodiment, the speakers 21 may be disposed on the air flow guide panel 20 as illustrated in FIG. 20.)

A width W of the section 15 is set equal to or less than about ½ of the wavelength of a sound wave of 2,000 Hz, and is desirably set to 85 mm or less. With this setting, a sound wave passing through the section 15 can be regarded as a substantially plane wave, that is, the inside of the section can be regarded as a one-dimensional sound field. In particular, a sufficient noise canceling effect can be obtained in a low frequency range of 2,000 Hz or less, where active noise cancellation is targeted.

At a position opposing the front panel 3, an air filter 8 for collecting and removing dust contained in the air sucked from the inlet 5 is provided. In a space formed between the front panel 3 and the air filter 8, an air filter cleaning device (not shown) for removing the dust accumulated on the air filter 8 is provided. Between the fan 7 and the air filter 8 in the blower passage 6, an indoor heat exchanger 9 having a bent structure provided with pipes (not shown) at a plurality of stages in a plurality of rows is disposed so as to oppose the inlet 4. The indoor heat exchanger 9 is connected to a compressor (not shown) of the outdoor unit placed outdoors, and a refrigeration cycle is operated by the driving of the compressor. Further, an electric dust collector (not shown) is provided between the air filter 8 and the indoor heat exchanger 9.

Next, the principle of operation noise control, which is the feature of the air conditioner according to the present invention, is described while comparing with conventional one. First, the principle of the operation noise control of the air conditioner according to the present invention is described in comparison with the conventional one. FIG. 5(*a*) is a principle explanatory view of the operation noise control of the air conditioner according to the present invention. FIG. 5(*b*) is a principle explanatory view of operation noise control of an air conditioner in the related art. In FIG. 5(*b*) of the related art, the same portions as those in the above-mentioned air conditioner according to the present invention are denoted by the same reference symbols. Further, for simple description, FIG. 5(*a*) of the present invention and FIG. 5(*b*) of the related art both omit the vertical louvers disposed in the outlet 5, and FIG. 5(*b*) of the related art further omits horizontal louvers disposed in the outlet 5.

As illustrated in FIGS. 5(*a*) and 5(*b*), in both the indoor units 1 of the air conditioners of the present invention and the related art, when the height of the outlet 5 at a position at which the speaker 21 is installed is represented by L1, a space C1 having the radius L1 with the speaker 21 being the center is a space through which sound propagates as a spherical wave.

In the conventional air conditioner not provided with the air flow guide panel 20, as illustrated in FIG. 5(*b*), a closed space in the vicinity of the outlet 5 (in a space C2 having a radius L2 with the speaker 21 being the center, a region surrounded by the upper surface, the lower surface, and the left and right side surfaces of the blower passage 6) is equal to or smaller than the space C1 (in the example of FIG. 5(*b*), C1≈C2). Accordingly, a sound wave radiated from the speaker 21 is less likely to be a plane wave, and the closed space becomes a three-dimensional sound field in which the sound propagates as a spherical wave in a free space. Thus, the conventional air conditioner has a problem that a sufficient noise canceling effect cannot be obtained.

In contrast, the air conditioner according to the present invention includes, as illustrated in FIG. 5(*a*), the air flow guide panel 20 which is capable of pivoting vertically in the vicinity of the outlet 5 so as to extend the upper surface or the lower surface of the blower passage 6. Accordingly, a closed space C2 in the vicinity of the outlet 5 (in a space C2 having a radius L2 with the speaker 21 being the center, a region surrounded by the inner surface of the air flow guide panel 20 and the upper surface, the lower surface, and the left and right side surfaces of the blower passage 6) can be enlarged to be larger than the space C1. The enlarged closed space C2 corresponds to the duct-like outlet passage, and in this duct-like outlet passage, a sound wave radiated from the speaker 21 can be allowed to propagate as a plane wave. Thus, a sufficient noise canceling effect can be obtained.

FIG. 6 are graphs showing the noise reduction effect obtained by the operation noise control of the air conditioner according to the present invention in comparison with that of the air conditioner in the related art. In the air conditioner according to the present invention, as illustrated in FIG. 6(*a*), the sound pressure level is significantly reduced in the measurement frequency range (0 to 5,000 Hz). However, in the air conditioner in the related art, the sound pressure level shows little change in the measurement frequency range (0 to 5,000 Hz). Thus, the superiority of the noise canceling effect of the present invention has been confirmed even by experiment.

It can be understood from the findings above that the reason why the air conditioner of the present invention exhibits the noise canceling effect is because the duct-like outlet passage through which a sound wave can propagate as a plane wave is formed in the vicinity of the outlet 5. In this sense, the air flow guide panel 20 needs to have a length at least equal to or more than the height L1 of the outlet 5 at the position at which the speaker 21 is installed (the distance from the center of the speaker 21 to the lower surface of the blower passage 6 in the direction perpendicular to the surface on which the speaker 21 is installed).

By the way, the noise canceling effect realized by the air conditioner according to the present invention is a composite effect including not only the noise canceling effect by the duct-like outlet passage but also the actions of (a) sound insulation, (b) reflection and interference, and (c) diffraction by the air flow guide panel 20 itself. That is, owing to (a) the sound insulation effect by the air flow guide panel 20 which is disposed so as to cover over the outlet 5, (b) the reflection and interference effect by the closed space surrounded by the inner surface of the air flow guide panel 20 and the upper surface, the lower surface, and the left and right side surfaces of the blower passage 6, and (c) the diffraction effect obtained because the air flow direction (blowing direction) is front upward or downward, noise is less likely to diffuse in the room, which can contribute to the reduction of noise.

Figure 7:
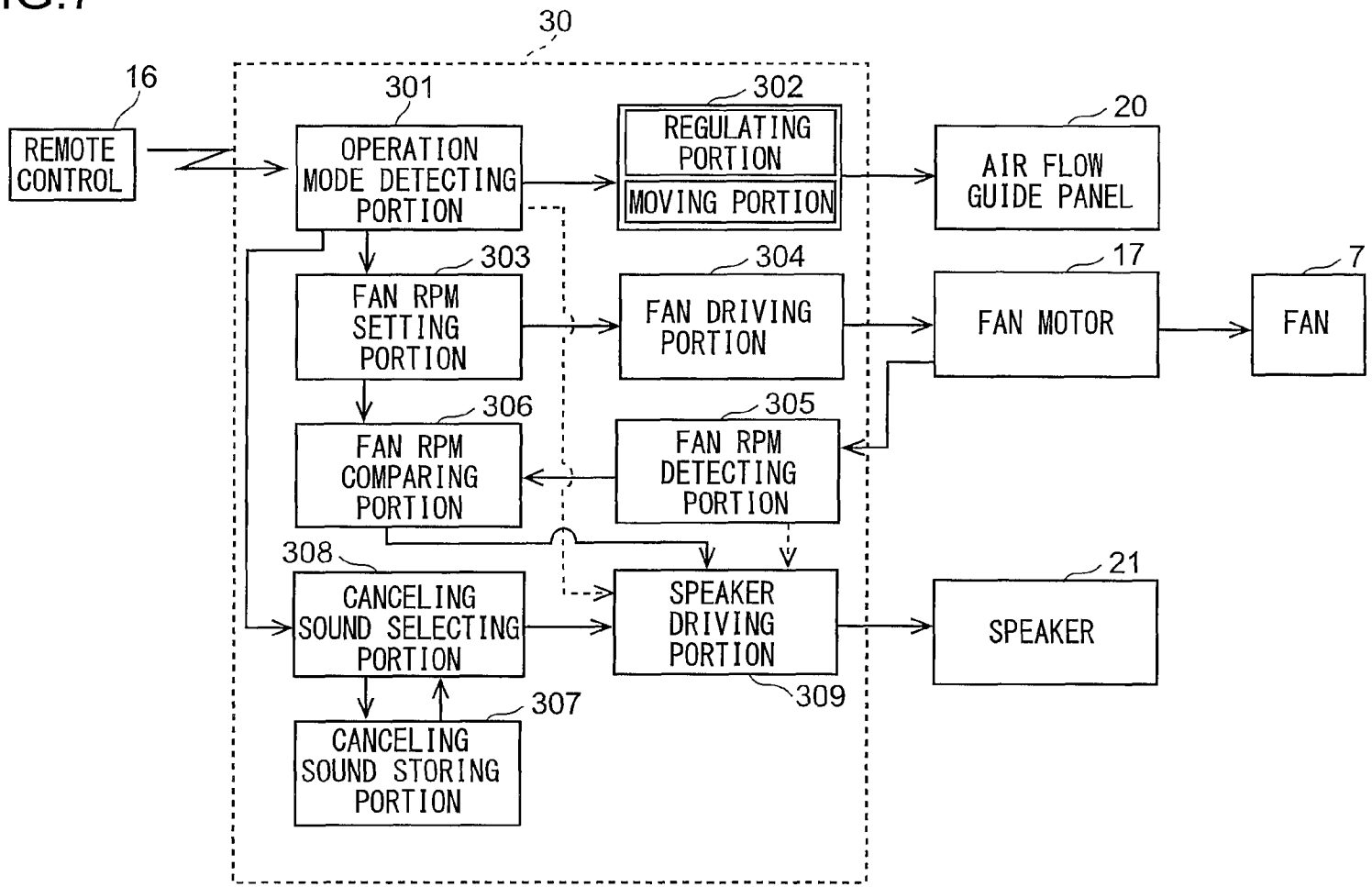
FIG. 7 is a block diagram illustrating an operation noise control system for the air conditioner according to the first embodiment.

Next, an operation noise control system according to the air conditioner of this embodiment is described with reference to a block diagram of FIG. 7. FIG. 7 illustrates only a control system related to the operation noise control, which is the most characteristic part of the present invention, and omits other control systems necessary for the air conditioner, such as a control system for a refrigeration cycle apparatus and a pivot control system for the vertical louvers 12.

A control portion 30 is constituted by a microcomputer or the like, and includes, as illustrated in FIG. 7, an operation mode detecting portion 301 for detecting an operation mode of the air conditioner (such as modes of High, Medium, and Low of air volume for cooling operation and heating operation each) in response to an input of a signal from a remote control 14, an air flow guide panel driving portion 302 including the above-mentioned regulating portion and the above-mentioned moving portion, for controlling the air flow guide panel 20 in accordance with the detected operation mode, a fan rpm setting portion 303 for setting the rpm of the fan 7 in accordance with the detected operation mode, a fan driving portion 304 for driving a fan motor 17 at the set rpm, a fan rpm detecting portion 305 for detecting the rpm of the fan 7 based on an output of the fan motor 17, a fan rpm comparing portion 306 for comparing the detected rpm of the fan 7 with the rpm of the fan 7 which is set in accordance with the operation mode, a canceling sound storing portion 307 for storing a plurality of kinds of sound wave signals which are preset for respective operation modes, a canceling sound selecting portion 308 for selecting a sound wave signal corresponding to the operation mode from among the stored sound wave signals, and a speaker driving portion 309 for inputting the selected sound wave signal to the speaker 21.

The speaker driving portion 309 directly receives a signal from the operation mode detecting portion 301 or the fan rpm detecting portion 305 as indicated by dotted lines of FIG. 7. When the operation mode is other than a preset operation mode or when the detected rpm of the fan 7 is equal to or lower than a preset rpm, the speaker driving portion 309 is controlled so that a sound wave is not radiated from the speaker 21. With this, active noise cancellation can be prevented from being operated more than necessary and can be limited to the case where it feels relatively uncomfortable with noise, thereby performing the active noise cancellation efficiently and effectively.

Figure 8:
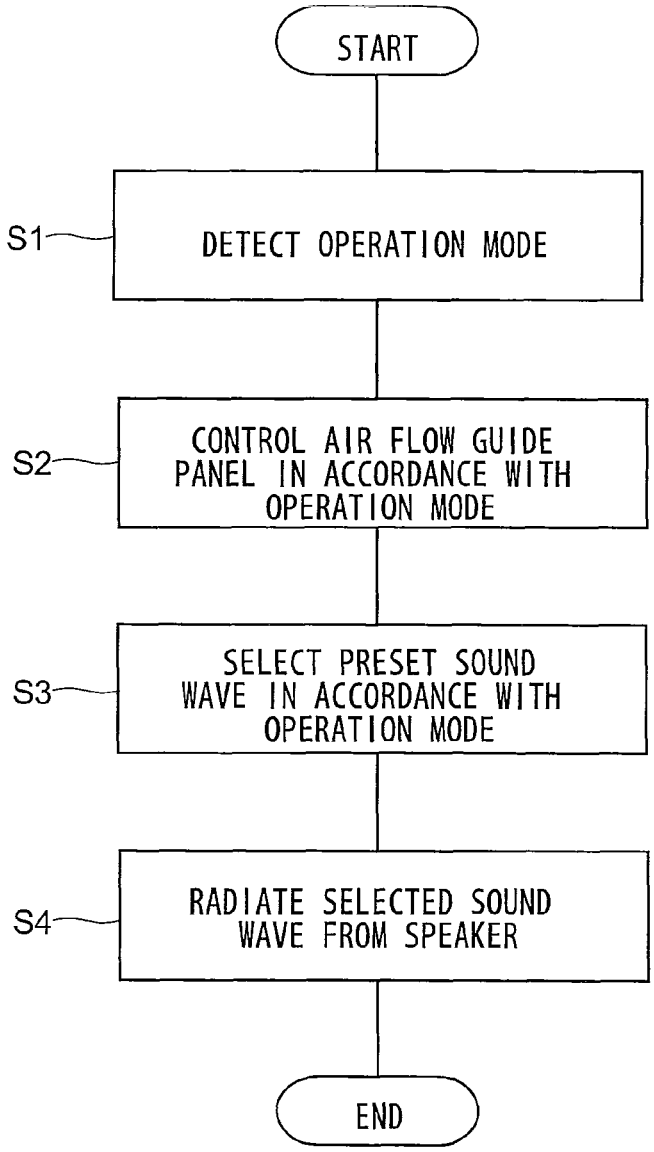
FIG. 8 is a flowchart illustrating an example of an operation noise control method for the air conditioner according to the first embodiment.

Next, an example of an operation noise control method for the air conditioner of this embodiment having the above-mentioned configuration is described with reference to a flowchart of FIG. 8. First, in Step S1, an operation mode is detected. In Step S2, the air flow guide panel 20 is operated in accordance with the operation mode and is controlled so as to form the duct-like outlet passage 10 or 11 illustrated in FIG. 2 or 3 in the vicinity of the outlet 5. In Step S3, a preset sound wave is selected in accordance with the operation mode. In Step S4, the selected sound wave is radiated from the speaker 21.

For example, when cooling operation is started, first, the indoor unit 1 of the air conditioner receives the signal of the remote control 13 and then the operation detection mode detecting portion 301 detects the operation mode (Step S1).

Next, the air flow guide panel 20 operates in accordance with the operation mode and is disposed so as to be open upward while covering over the outlet 5 as illustrated in FIG. 2 (Step S2). In this way, the duct-like outlet passage 10 is formed.

Then, the fan 7 is rotationally-driven so that air is sucked into the indoor unit 1 from the inlet 4. The air passes through the blower passage 6 and is delivered into the room from the outlet 5. Noise generated by the indoor unit 1, mainly blower noise generated when the fan 7 is rotationally-driven, is also radiated into the room. As a countermeasure, a preset sound wave is selected in accordance with the operation mode (Step S3), and the selected sound wave is radiated from the speaker 21 (Step S4). In this way, in the duct-like outlet passage 10, the noise, mainly the blower noise generated when the fan 7 is rotationally-driven, can be canceled out, thereby performing active noise cancellation.

According to the operation noise control method in this example, in accordance with the operation mode of the air conditioner, the duct-like outlet passage 10, which can be a one-dimensional sound field, is formed in the vicinity of the outlet 5 located on the downstream side of the fan 7 in the blower passage 6. Then, in this duct-like outlet passage, the sound wave which is preset in accordance with the operation mode is radiated from the speaker 21. Therefore, the operation noise is efficiently canceled out while passing through the duct-like outlet passage 10. With this, the noise to be radiated into the room can be reliably reduced, and a sufficient noise canceling effect can be obtained.

Figure 9:
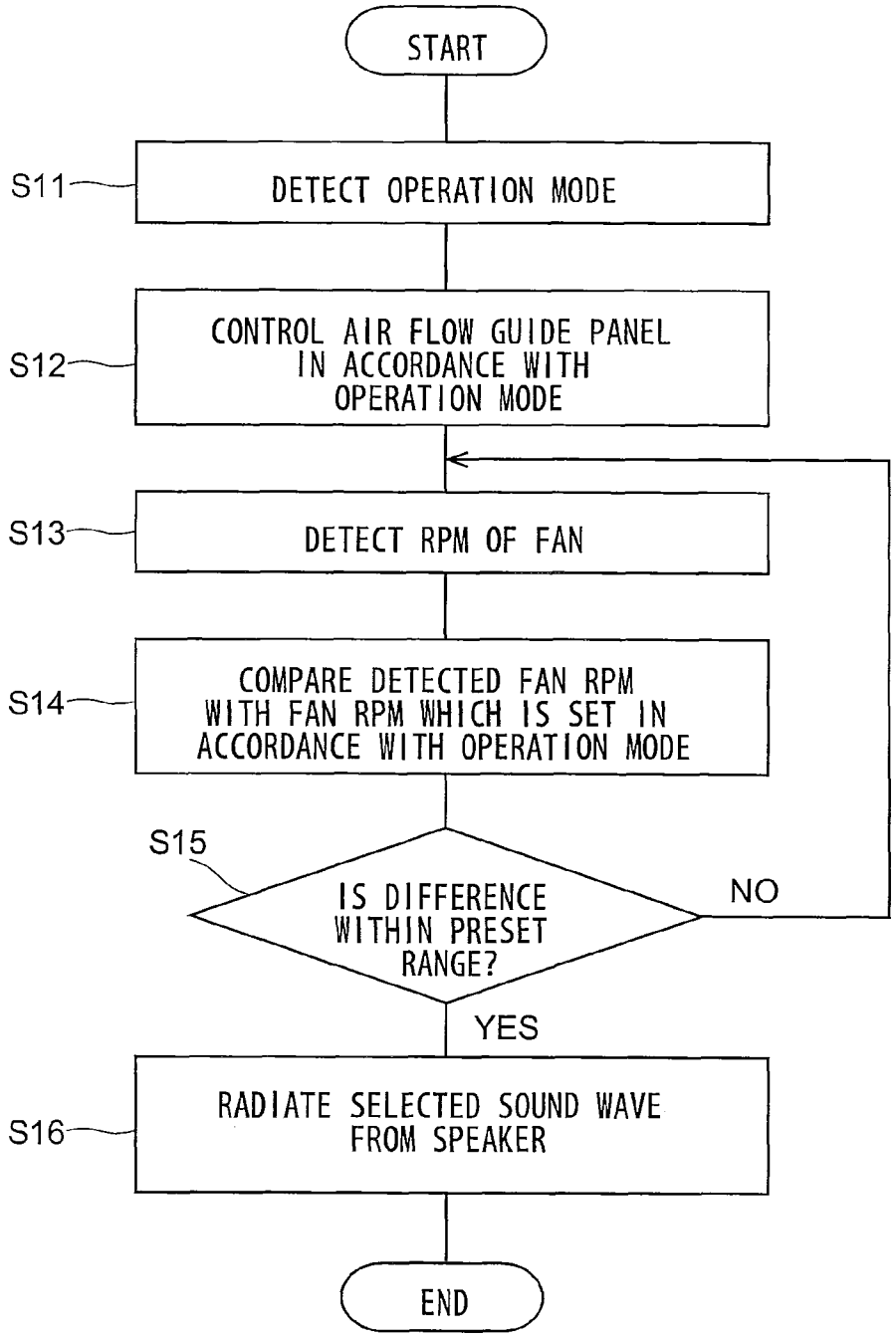
FIG. 9 is a flowchart illustrating an example of the operation noise control method for the air conditioner according to the first embodiment.

Next, another example of the operation noise control method according to the air conditioner of this embodiment is described with reference to a flowchart of FIG. 9. Steps S11 and S12, in which the operation mode is detected and the air flow guide panel 20 is controlled so as to form the duct-like outlet passage, are the same as described above for Steps S1 and S2 of FIG. 8.

In the operation noise control method in this example, after that, in Step S13, the rpm of the fan 7 is detected, and in Step S14, the detected rpm of the fan 7 is compared with the rpm of the fan 7 which is set in accordance with the operation mode. When a difference between the detected rpm of the fan 7 and the rpm of the fan 7 which is set in accordance with the operation mode is within a preset range (YES in Step S15), selected sound is radiated from the speaker 21 in Step S16. In other words, when the difference between the detected rpm of the fan 7 and the rpm of the fan 7 which is set in accordance with the operation mode is not within a preset range (NO in Step S15), the processing returns to Step S13, and Steps S13 to S15 are repeated until the difference falls within the range.

The operation noise control method in this example is targeted at steady-state noise, which is relatively stable. Therefore, active noise cancellation can be performed relatively easily.

Second Embodiment

Figure 10:
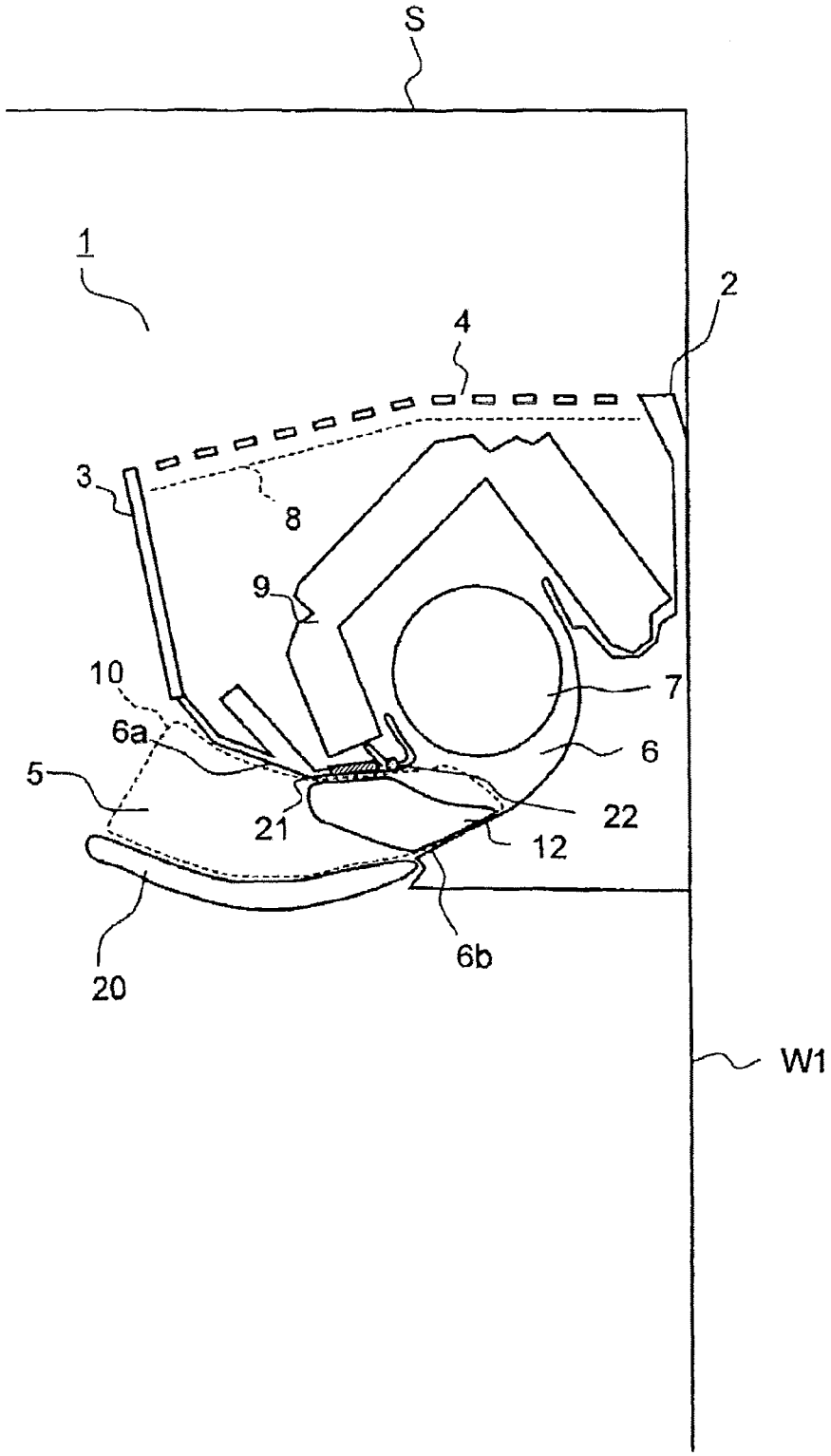
FIG. 10 is a schematic side cross-sectional view of an indoor unit illustrating an example of an operating state of an air conditioner according to a second embodiment.

FIG. 10 is a schematic side cross-sectional view illustrating an example of an operating state of an indoor unit 1 of an air conditioner according to a second embodiment. In FIG. 10, the same portions as those in the above-mentioned indoor unit of the air conditioner according to the first embodiment illustrated in FIGS. 1 to 3 are denoted by the same reference symbols, and descriptions thereof are omitted.

As illustrated in FIG. 10, the indoor unit 1 of the air conditioner according to this embodiment includes a reference microphone (reference sound detecting means) 22 for detecting a sound wave of operation noise including a blower sound of the fan 7, the reference microphone 22 being disposed on the upper wall 6*a* of the blower passage 6 so as to face the blower passage 6. Then, a sound wave in antiphase to the sound wave detected by the reference microphone 22 is radiated from the speaker 21. It is desired to dispose the reference microphone 22 on the upstream side of the speaker 21 in the duct-like outlet passage 10 as illustrated in FIG. 10 so as not to detect a sound wave radiated from the speaker 21, which is not a detection target of the reference microphone.

Figure 11:
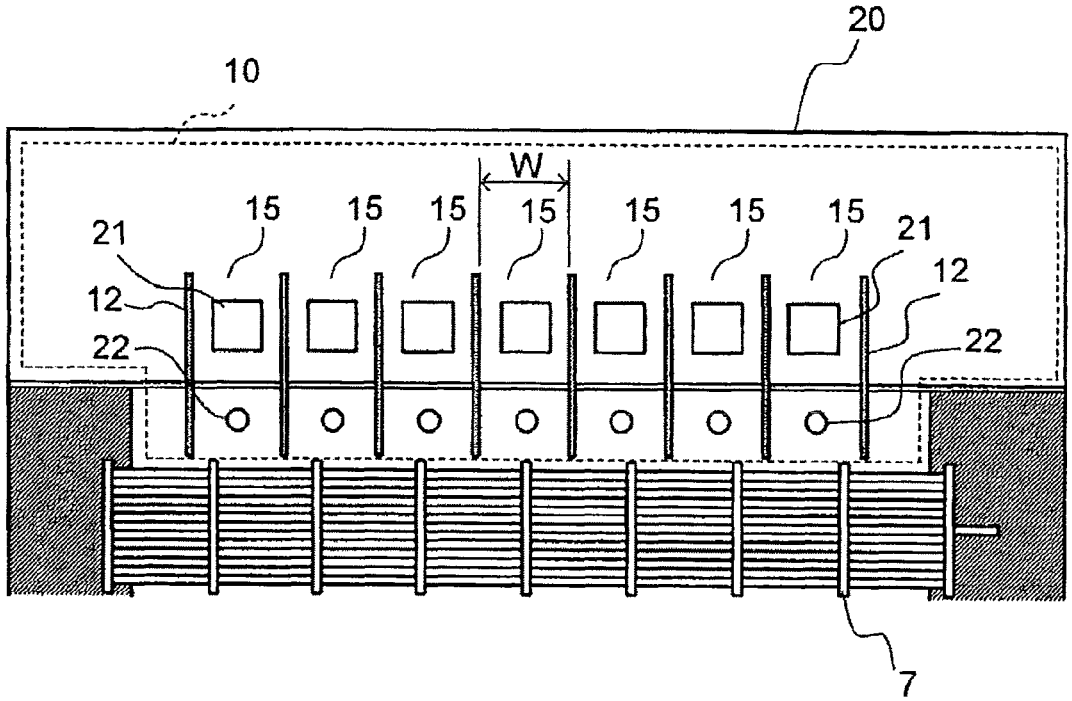
FIG. 11 is a schematic horizontal cross-sectional view illustrating the vicinity of an outlet of the indoor unit of the air conditioner according to the second embodiment.

As illustrated in FIG. 11 corresponding to a schematic horizontal cross-sectional view of the vicinity of the outlet, a plurality of the speakers 21 and a plurality of the reference microphones 22 are disposed for the respective sections 15 divided by the vertical louvers 12, thereby performing canceling control of the operation noise independently for each section 15. With this, active noise cancellation can be performed satisfactorily for each small sectioned space. (FIG. 11 illustrates the speakers 21 as if those are disposed on the air flow guide panel 20 and illustrates the reference microphones 22 as if those are disposed on the lower wall 6*b* of the blower passage 6, but, in this embodiment, the speakers 21 and the reference microphones 22 are disposed on the upper wall 6*a* of the blower passage 6 as illustrated in FIG. 10. FIG. 11 is a schematic horizontal cross-sectional view illustrating that the plurality of speakers 21 and the plurality of reference microphones 22 are disposed for the respective sections 15. Alternatively, however, as another embodiment, the speakers 21 and the reference microphones 22 may be disposed on the air flow guide panel 20 as illustrated in FIG. 20.)

A width W of the section 15 is set equal to or less than about ½ of the wavelength of a sound wave of 2,000 Hz, and is desirably set to 85 mm or less. With this setting, a sound wave passing through the section 15 can be regarded as a substantially plane wave, that is, the inside of the section 15 can be regarded as a one-dimensional sound field. In particular, a sufficient noise canceling effect can be obtained in a low frequency range of 2,000 Hz or less, where active noise cancellation is targeted.

Figure 12:
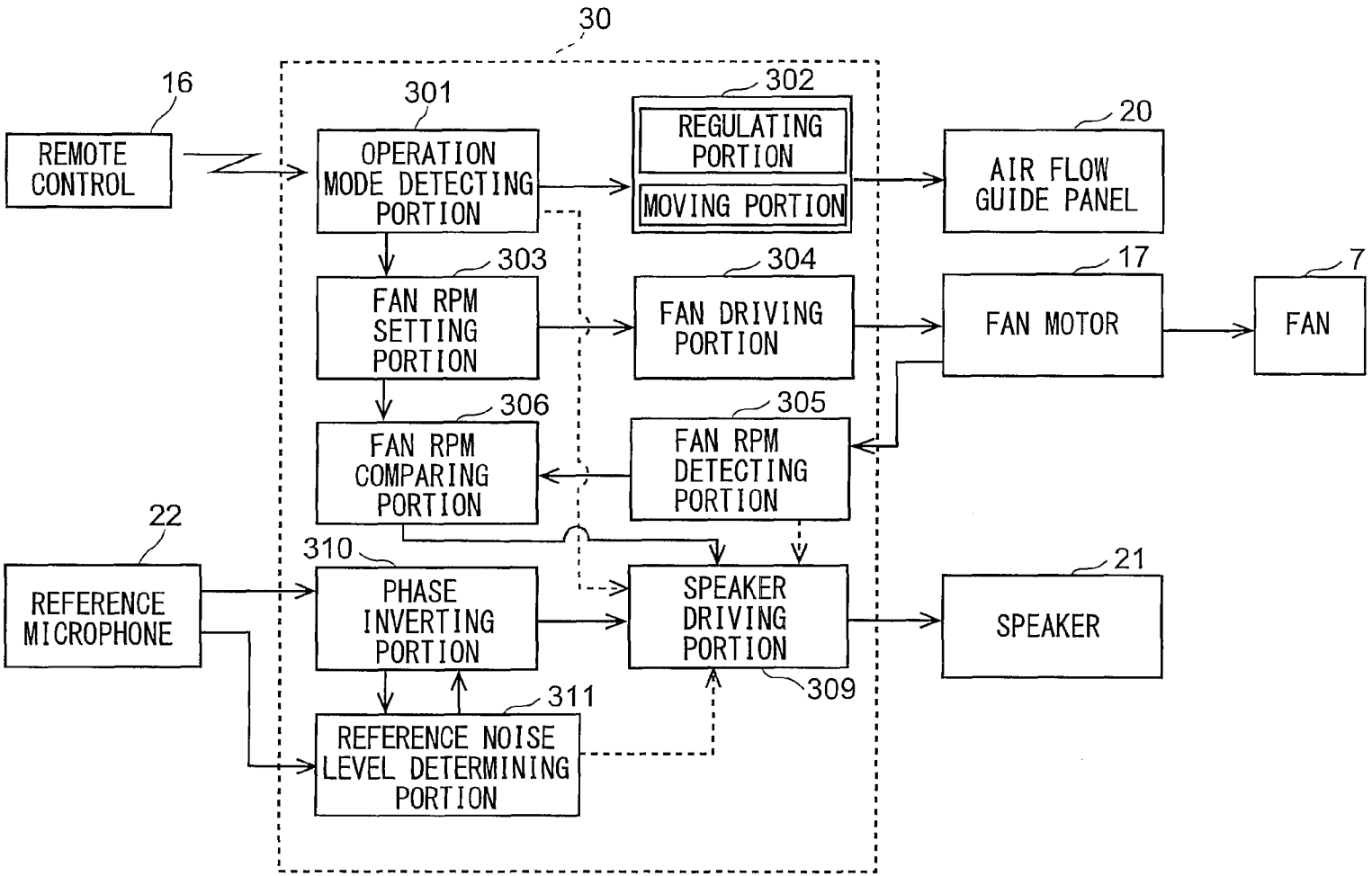
FIG. 12 is a block diagram illustrating an operation noise control system for the air conditioner according to the second embodiment.

Next, an operation noise control system according to the air conditioner of this embodiment is described with reference to a block diagram of FIG. 12. FIG. 12 illustrates only a control system related to the operation noise control, which is the most characteristic part of the present invention, and omits other control systems necessary for the air conditioner, such as a control system for a refrigeration cycle and a pivot control system for the vertical louvers 12. Further, in FIG. 12, the same portions as those in the above-mentioned operation noise control system of the air conditioner according to the first embodiment illustrated in FIG. 7 are denoted by the same reference symbols, and descriptions thereof are omitted.

As illustrated in FIG. 12, a control portion 30 includes, instead of the canceling sound selecting portion 308 and the canceling sound storing portion 307 illustrated in the control system of the air conditioner according to the first embodiment of FIG. 7, a phase inverting portion 310 for inverting the phase of a sound wave of operation noise detected by the reference microphone 22. The speaker driving portion 309 inputs an antiphase sound wave signal obtained through inversion by the phase inverting portion 310 to the speaker 21.

In this embodiment, the control portion 30 further includes a reference noise level determining portion 311 for comparing a sound pressure (noise level) of the operation noise detected by the reference microphone 22 with a predetermined reference value and outputting a result of the comparison.

The speaker driving portion 309 directly receives a signal from the operation mode detecting portion 301, the fan rpm detecting portion 305, or the reference noise level determining portion 311 as indicated by dotted lines of FIG. 12. When the operation mode is other than a preset operation mode, when the detected rpm of the fan 7 is equal to or lower than a preset rpm, or when the operation noise detected by the reference microphone 22 is equal to or lower than a preset noise level, the speaker driving portion 309 is controlled so that a sound wave is not radiated from the speaker 21. With this, active noise cancellation can be prevented from being operated more than necessary and can be limited to the case where it feels relatively uncomfortable with noise, thereby performing the active noise cancellation efficiently and effectively.

Figure 13:
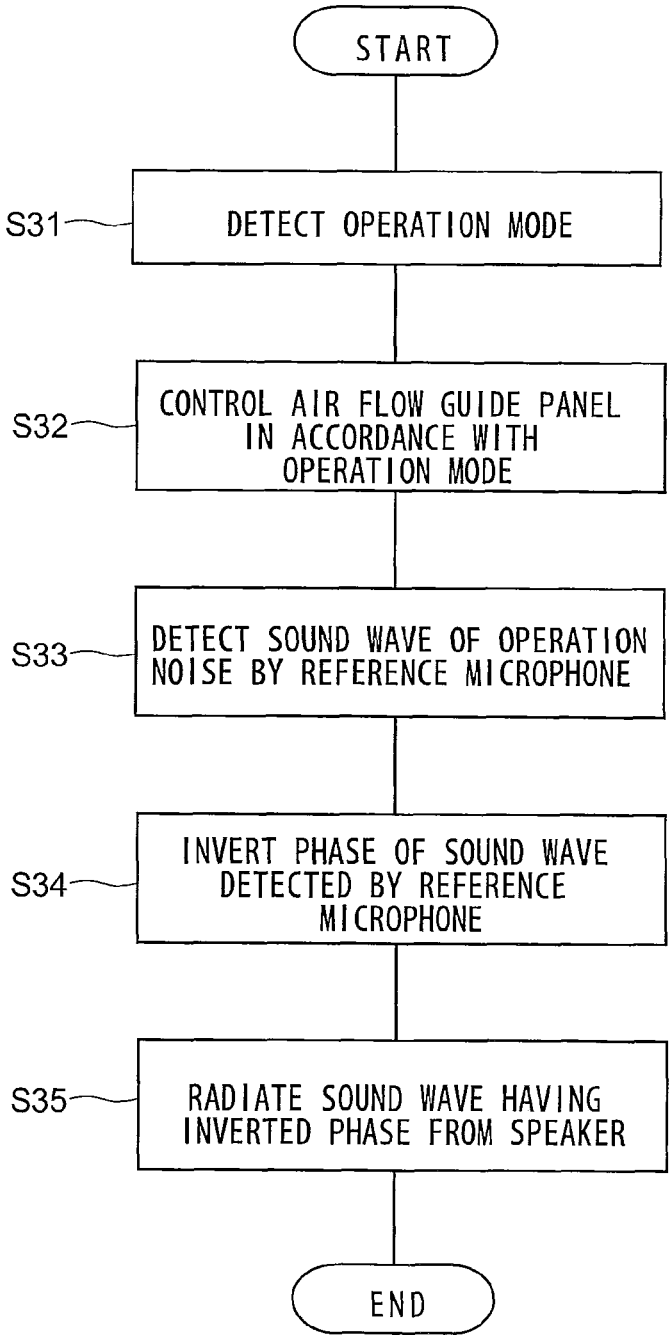
FIG. 13 is a flowchart illustrating an example of an operation noise control method for the air conditioner according to the second embodiment.

Next, an example of an operation noise control method for the air conditioner of this embodiment having the above-mentioned configuration is described with reference to a flowchart of FIG. 13. First, in Step S31, an operation mode is detected. In Step S32, the air flow guide panel 20 is operated in accordance with the operation mode and is controlled so as to form the duct-like outlet passage in the vicinity of the outlet 5. In Step S33, a sound wave of operation noise generated when the fan 7 is driven is detected by the reference microphone 22. In Step S34, the phase of the detected sound wave is inverted. In Step S35, the obtained antiphase sound wave is radiated from the speaker 21.

According to the operation noise control method in this example, in accordance with the operation mode of the air conditioner, the duct-like outlet passage 10, which can be a one-dimensional sound field, is formed in the vicinity of the outlet 5 located on the downstream side of the fan 7 in the blower passage 6. Then, in this duct-like outlet passage 10, the sound wave in antiphase to the sound wave of the operation noise including a blower sound of the fan 7 is radiated. Therefore, the operation noise is efficiently canceled out while passing through the duct-like outlet passage 10. With this, the noise to be radiated into the room can be reliably reduced, and a sufficient noise canceling effect can be obtained.

Further, according to the operation noise control method in this example, it is possible to detect sound which is actually generated when the fan 7 is driven and to radiate sound having such a waveform as to cancel against the actually generated sound. Thus, the accuracy of the noise canceling effect can be increased.

Figure 14:
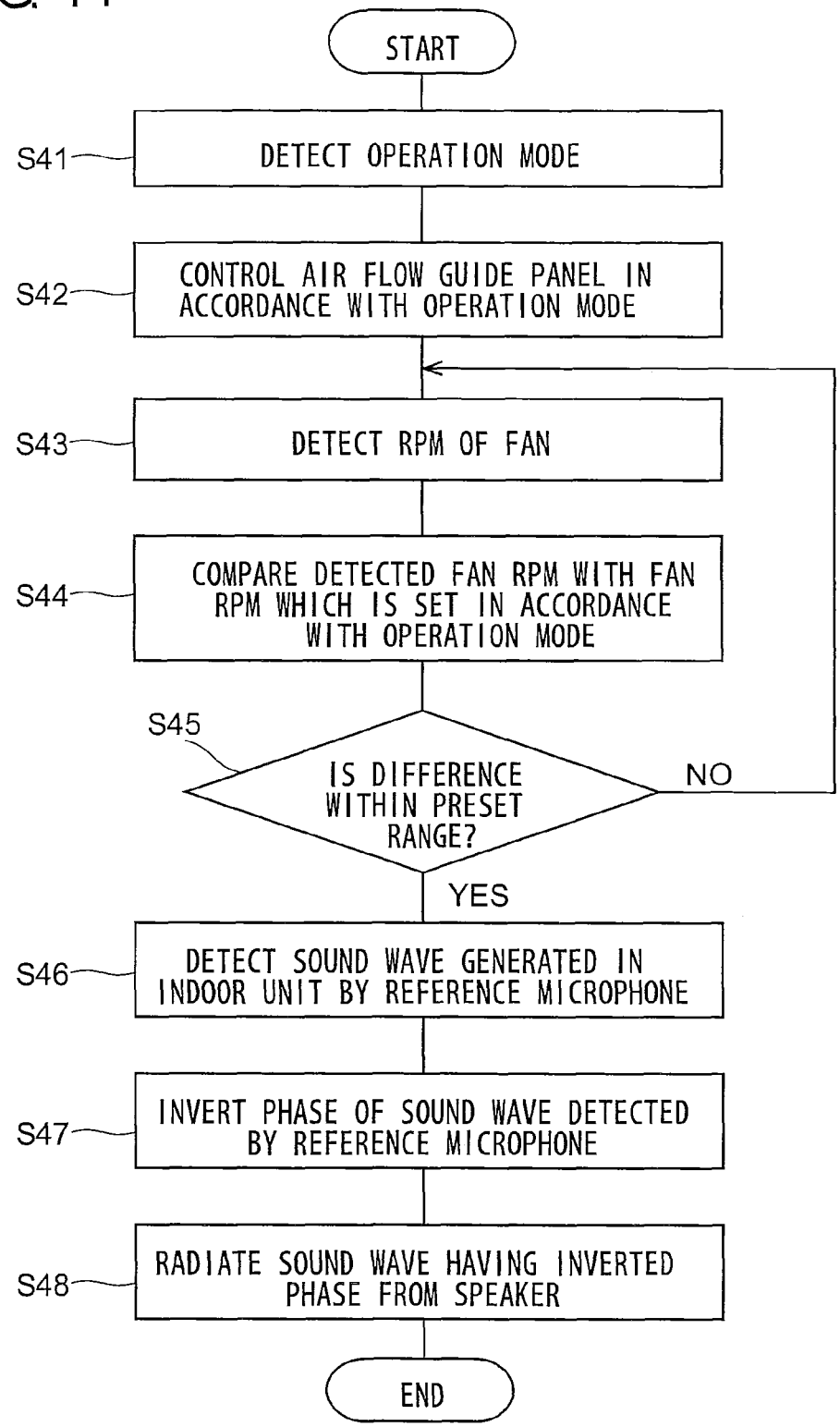
FIG. 14 is a flowchart illustrating another example of the operation noise control method for the air conditioner according to the second embodiment.

Next, another example of the operation noise control method according to the air conditioner of this embodiment is described with reference to a flowchart of FIG. 14. Steps S41 and S42, in which the operation mode is detected and the air flow guide panel 20 is controlled so as to form the duct-like outlet passage, are the same as described above for Steps S31 and S32 of FIG. 13.

In the operation noise control method in this example, after that, in Step S43, the rpm of the fan 7 is detected, and in Step S44, the detected rpm of the fan 7 is compared with the rpm of the fan 7 which is set in accordance with the operation mode. When a difference between the detected rpm of the fan 7 and the rpm of the fan 7 which is set in accordance with the operation mode is within a preset range (YES in Step S45), in Step S46, a sound wave of operation noise generated when the fan 7 is driven is detected by the reference microphone 22. In Step S47, the phase of the detected sound wave is inverted. In Step S48, the obtained antiphase sound wave is radiated from the speaker 21. In other words, when the difference between the detected rpm of the fan 7 and the rpm of the fan 7 which is set in accordance with the operation mode is not within a preset range (NO in Step S45), the processing returns to Step S43, and Steps S43 to S45 are repeated until the difference falls within the range.

The operation noise control method in this example is targeted at steady-state noise, which is relatively stable. Therefore, active noise cancellation can be performed relatively easily.

Third Embodiment

Figure 15:
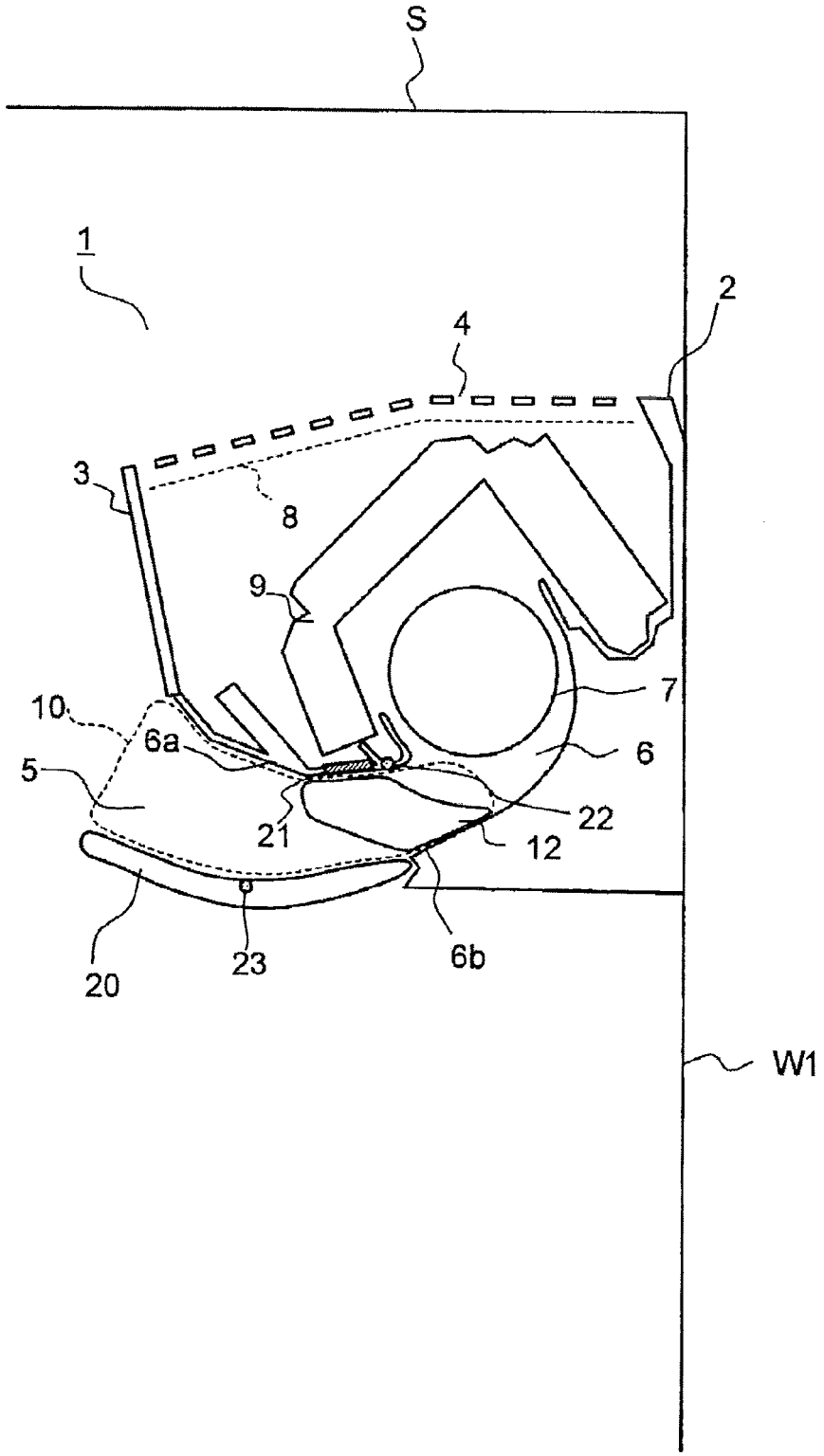
FIG. 15 is a schematic side cross-sectional view of an indoor unit illustrating an example of an operating state of an air conditioner according to a third embodiment.

FIG. 15 is a schematic side cross-sectional view illustrating an example of an operating state of an indoor unit 1 of an air conditioner according to a third embodiment. In FIG. 15, the same portions as those in the above-mentioned indoor unit of the air conditioner according to the second embodiment are denoted by the same reference symbols, and descriptions thereof are omitted.

As illustrated in FIG. 15, the indoor unit 1 of the air conditioner according to this embodiment includes, in addition to the reference microphone 22, a correction microphone (correction sound detecting means) 23 for detecting a sound wave after operation noise is canceled out, the correction microphone 23 being disposed on the air flow guide panel 20. With this, a sound wave to be radiated from the speaker 21 is corrected so that a noise level detected by the correction microphone 23 falls within a predetermined range. In this case, it is desired to dispose the correction microphone 23 on the downstream side of the speaker 21 in the duct-like outlet passage 10 so as not to detect operation noise, which is not a detection target of the correction microphone.

Figure 16:
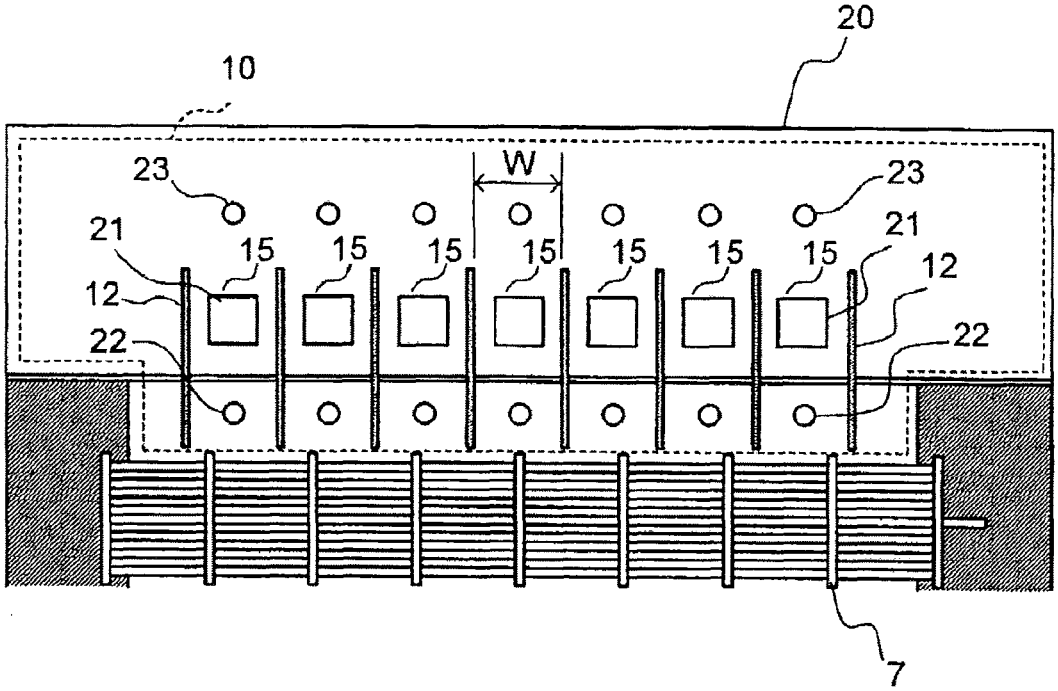
FIG. 16 is a schematic horizontal cross-sectional view illustrating the vicinity of an outlet of the indoor unit of the air conditioner according to the third embodiment.

As illustrated in FIG. 16 corresponding to a schematic horizontal cross-sectional view of the vicinity of the outlet, a plurality of the speakers 21 and a plurality of the reference microphones 22 are disposed for the respective sections 15 (see FIG. 11) divided by the vertical louvers 12, thereby performing canceling control of the operation noise independently for each section 15. With this, active noise cancellation can be performed satisfactorily for each small sectioned space. (FIG. 16 illustrates the speakers 21 and the correction microphones 23 as if those are disposed on the air flow guide panel 20 and illustrates the reference microphones 22 as if those are disposed on the lower wall 6*b* of the blower passage 6, but, in this embodiment, the speakers 21 and the reference microphones 22 are disposed on the upper wall 6*a* of the blower passage 6 and the correction microphones 23 are disposed on the air flow guide panel 20 as illustrated in FIG. 15. FIG. 16 is a schematic horizontal cross-sectional view illustrating that the plurality of speakers 21, the plurality of reference microphones 22, and the plurality of correction microphones 23 are disposed for the respective sections 15. Alternatively, however, as another embodiment, the speakers 21, the reference microphones 22, and the correction microphones 23 may be disposed on the air flow guide panel 20 as illustrated in FIG. 20.)

A width W of the section 15 is set equal to or less than about ½ of the wavelength of a sound wave of 2,000 Hz, and is desirably set to 85 mm or less. With this setting, a sound wave passing through the section 15 can be regarded as a substantially plane wave, that is, the inside of the section can be regarded as a one-dimensional sound field. In particular, a sufficient noise canceling effect can be obtained in a low frequency range of 2,000 Hz or less, where active noise cancellation is targeted.

Further, as illustrated in FIG. 16, the plurality of correction microphones 23 are each disposed outside the section 15 so that the speaker 21 is sandwiched between the reference microphone 22 and the correction microphone 23 in the blower direction. In this configuration, for example, the air flow guide panel 20 pivots so as to be open upward in the case of cooling (see FIG. 15) and so as to be open downward in the case of heating (see FIG. 3) and is disposed so as to cover over the outlet 5. In either case of upward opening or downward opening, a detection target sound wave can be detected satisfactorily by the reference microphone 22 disposed on the upstream side of the speaker 21 or the correction microphone 23 disposed on the downstream side of the speaker 21.

Figure 17:
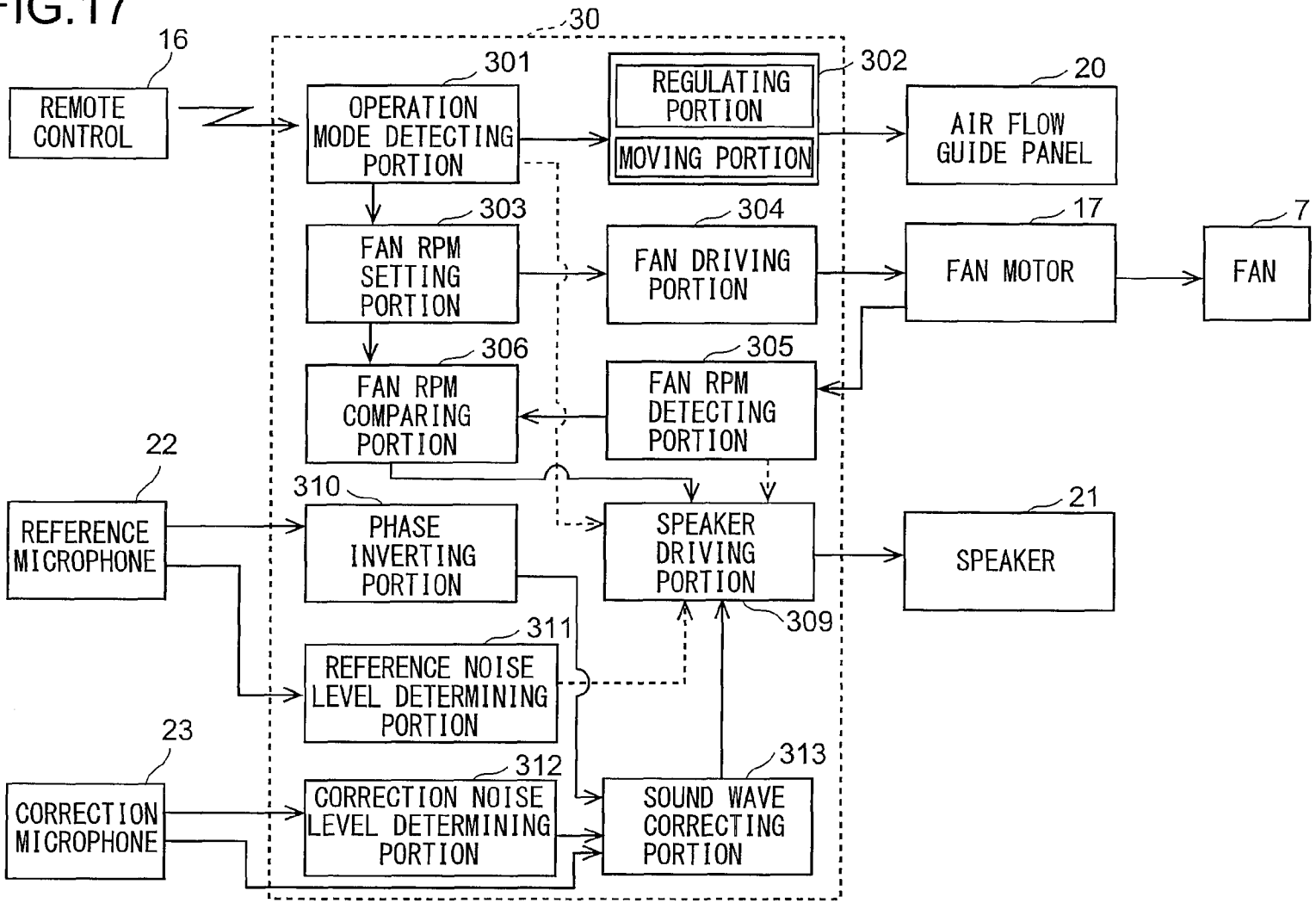
FIG. 17 is a block diagram illustrating an operation noise control system for the air conditioner according to the third embodiment.

Next, an operation noise control system according to the air conditioner of this embodiment is described with reference to a block diagram of FIG. 17. FIG. 17 illustrates only a control system related to the operation noise control, which is the most characteristic part of the present invention, and omits other control systems necessary for the air conditioner, such as a control system for a refrigeration cycle and a pivot control system for the vertical louvers 12. Further, in FIG. 17, the same portions as those in the above-mentioned operation noise control system of the air conditioner according to the second embodiment illustrated in FIG. 12 are denoted by the same reference symbols, and descriptions thereof are omitted.

As illustrated in FIG. 17, a control portion 30 includes, in addition to the phase inverting portion 310 and the reference noise level determining portion 311 illustrated in the control system of the air conditioner according to the second embodiment of FIG. 12, a correction noise level determining portion 312 for comparing a sound pressure (noise level) of sound detected by the correction microphone 23 with a predetermined reference value and outputting a result of the comparison, and a sound wave correcting portion 313 for correcting an antiphase sound wave signal obtained through inversion by the phase inverting portion 310.

In this embodiment, the antiphase sound wave signal obtained through inversion by the phase inverting portion 310 is subjected to necessary correction processing by the sound wave correcting portion 313 and is then input to the speaker driving portion 309 as a canceling sound wave signal. When the correction noise level determining portion 312 determines that the noise level after cancellation is larger than a predetermined reference value, the sound wave correcting portion 313 calculates a correction signal from the sound wave detected by the correction microphone 23, and corrects the antiphase sound wave signal obtained through inversion by the phase inverting portion 310.

The speaker driving portion 309 directly receives a signal from the operation mode detecting portion 301, the fan rpm detecting portion 305, or the reference noise level determining portion 311 as indicated by dotted lines of FIG. 17. When the operation mode is other than a preset operation mode, when the detected rpm of the fan 7 is equal to or lower than a preset rpm, or when the operation noise detected by the reference microphone 22 is equal to or lower than a preset noise level, the speaker driving portion 309 is controlled so that a sound wave is not radiated from the speaker 21. With this, active noise cancellation can be prevented from being operated more than necessary and can be limited to the case where it feels relatively uncomfortable with noise, thereby performing the active noise cancellation efficiently and effectively.

Figure 18:
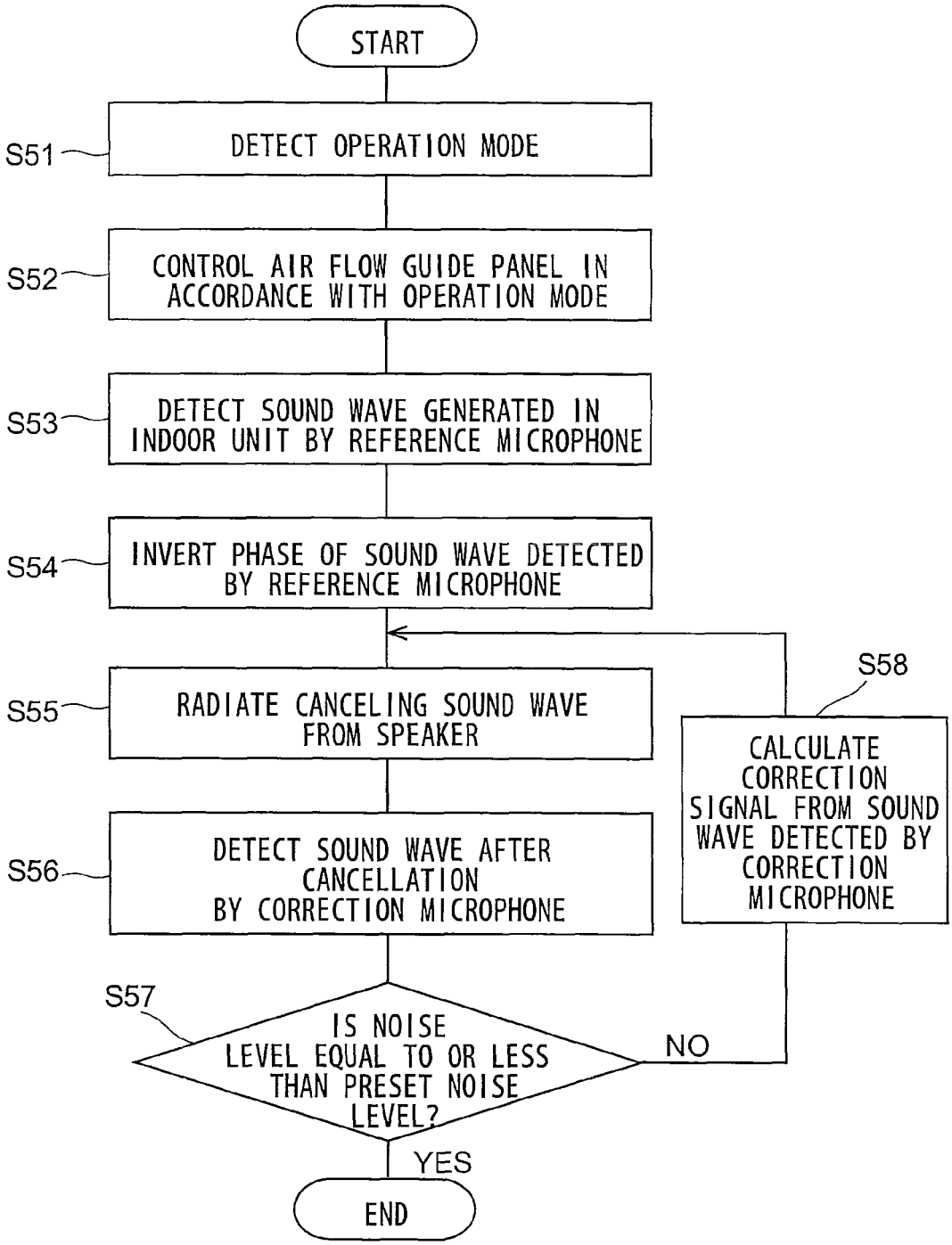
FIG. 18 is a flowchart illustrating an example of an operation noise control method for the air conditioner according to the third embodiment.

Next, an example of an operation noise control method for the air conditioner of this embodiment having the above-mentioned configuration is described with reference to a flowchart of FIG. 18. First, in Step S51, an operation mode is detected. In Step S52, the air flow guide panel 20 is operated in accordance with the operation mode and is controlled so as to form the duct-like outlet passage in the vicinity of the outlet 5. In Step S53, a sound wave of operation noise generated when the fan 7 is driven is detected by the reference microphone 22. In Step S54, the phase of the detected sound wave is inverted. In Step S55, the obtained antiphase sound wave (canceling sound wave) is radiated from the speaker 21.

In addition, in Step S56, a sound wave after cancellation is detected by the correction microphone 23, and in Step S57, the noise level detected by the correction microphone 23 is compared with a predetermined reference value. When it is determined that the noise level after cancellation is larger than the predetermined reference value (NO in Step S57), the correction signal is calculated from the sound wave detected by the correction microphone 23, and the antiphase sound wave signal obtained through inversion by the phase inverting portion 310 is corrected. Then, the processing returns to Step S55, and the corrected sound wave (canceling sound wave) is radiated from the speaker 21.

According to the operation noise control method in this example, in accordance with the operation mode of the air conditioner, the duct-like outlet passage 10, which can be a one-dimensional sound field, is formed in the vicinity of the outlet 5 located on the downstream side of the fan 7 in the blower passage 6. Then, in this duct-like outlet passage 10, the sound wave in antiphase to the sound wave of the operation noise including a blower sound of the fan 7 is radiated. Therefore, the operation noise is efficiently canceled out while passing through the duct-like outlet passage 10. With this, the noise to be radiated into the room can be reliably reduced, and a sufficient noise canceling effect can be obtained.

Further, according to the operation noise control method in this example, it is possible to detect sound which is actually generated when the fan 7 is driven and to radiate sound having such a waveform as to cancel against the actually generated sound. Thus, the accuracy of the noise canceling effect can be increased.

In addition, according to the operation noise control method in this example, the accuracy of the active noise cancellation can be increased more by feedback control of the noise level after cancellation.

Figure 19:
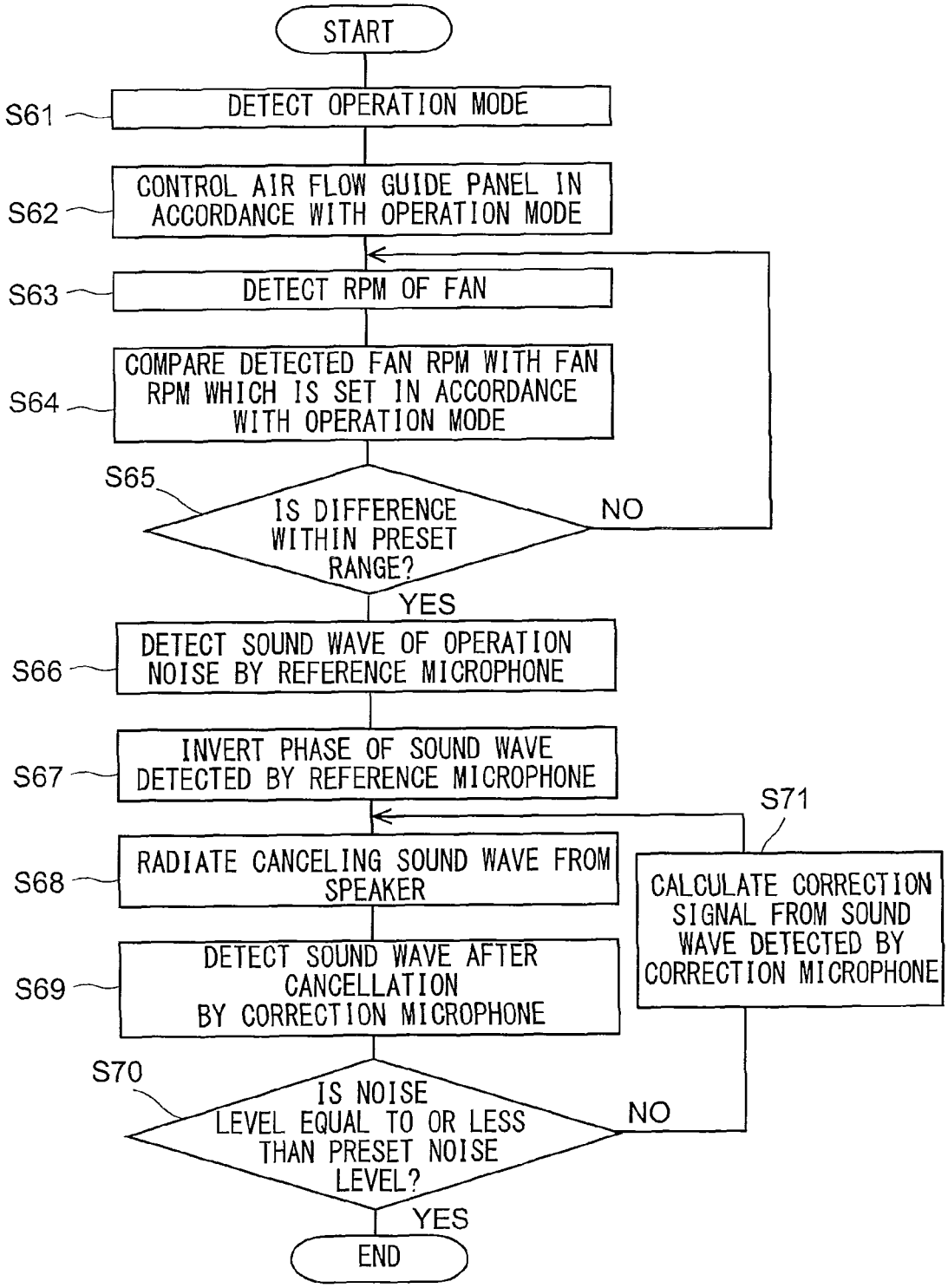
FIG. 19 is a flowchart illustrating another example of the operation noise control method for the air conditioner according to the third embodiment.

Next, another example of the operation noise control method according to the air conditioner of this embodiment is described with reference to a flowchart of FIG. 19. Steps S61 and S62, in which the operation mode is detected and the air flow guide panel 20 is controlled so as to form the duct-like outlet passage, are the same as described above for Steps S51 and S52 of the example in FIG. 17.

In the operation noise control method in this example, after that, in Step S63, the rpm of the fan 7 is detected, and in Step S64, the detected rpm of the fan 7 is compared with the rpm of the fan 7 which is set in accordance with the operation mode. When a difference between the detected rpm of the fan 7 and the rpm of the fan 7 which is set in accordance with the operation mode is within a preset range (YES in Step S65), in Step S66, a sound wave of operation noise generated when the fan 7 is driven is detected by the reference microphone 22. In Step S67, the phase of the detected sound wave is inverted. In Step S68, the obtained antiphase sound wave (canceling sound wave) is radiated from the speaker 21. In other words, when the difference between the detected rpm of the fan 7 and the rpm of the fan 7 which is set in accordance with the operation mode is not within a preset range (NO in Step S65), the processing returns to Step S63, and Steps S63 to S65 are repeated until the difference falls within the range. Steps S66 to S71 thereafter are the same as described above for Steps S55 to S58 of the example in FIG. 17.

The operation noise control method in this example is targeted at steady-state noise, which is relatively stable. Therefore, active noise cancellation can be performed relatively easily.

As described above for the air conditioner and the operation noise control method therefor according to the present invention by way of the first to third embodiments, according to the air conditioner or the operation noise control method therefor of the present invention, harsh operation noise of the air conditioner can be significantly reduced without exposing a user directly to cold air or warm air. Therefore, delivery of an imperceptible air flow can be realized, which enables the user to sense substantially no air flow and no sound, thereby preventing a feeling of discomfort to a user and greatly increasing comfort.

Further, the operation sound of the air conditioner can be significantly reduced, and hence the air volume of the indoor unit can also be increased without giving a user an uncomfortable feeling. In other words, the refrigeration cycle efficiency can be increased consequently, which can greatly contribute to energy saving.

Note that, the present invention is not limited to the above-mentioned embodiments, and appropriate modifications may be made thereto without departing from the spirit of the present invention.

For example, in the above-mentioned embodiment, the speaker 21 and the reference microphone 22 are provided on the upper wall 6*a* of the blower passage 6 constituting the casing of the indoor unit 1, and the correction microphone 23 is provided on the air flow guide panel 20. Alternatively, however, as illustrated in FIG. 20, the speaker 21, the reference microphone 22, and the correction microphone 23 may be provided on the air flow guide panel 20. In this case, the speaker 21 faces the casing of the indoor unit 1, and hence, owing to the diffraction effect, a sound wave radiated from the speaker 21 can be prevented from leaking into the room. Thus, the noise canceling effect is increased more. Further, when the reference microphone 22 and the correction microphone 23 are configured to be switchable, in both cases of the upward opening and the downward opening of the air flow guide panel 20, the active noise cancellation can be performed satisfactorily.

INDUSTRIAL APPLICABILITY

The present invention is applicable to an air conditioner to be used by being mounted on an indoor wall surface.

REFERENCE SIGNS LIST

1 indoor unit
2 cabinet
3 front panel
4 inlet
5 outlet
6 blower passage
7 fan (blower means)
10, 11 duct-like outlet passage
12 vertical louver
13 auxiliary panel
15 section
20 air flow guide panel (air flow direction changing means)
21 speaker (sound emitting means)
22 reference microphone
23 correction microphone
30 control portion

The invention claimed is:

1. An air conditioner to be used by being mounted on an indoor wall surface, comprising:

a casing;

an inlet provided to the casing, for introducing air in a room;

an outlet provided to the casing, for delivering conditioned air, which is obtained by conditioning air introduced from the inlet, to the room;

a blower for moving air from the inlet to the outlet;

a blower passage communicating between the inlet and the outlet;

a pivotable air flow guide panel provided in a vicinity of the outlet vertical louvers dividing the outlet into sections; and a plurality of speakers arranged at least one in each of the sections, each section being between two adjacent vertical louvers, wherein the air flow guide panel and the vertical louvers are operable to form a duct-like outlet passage serving as a one-dimensional sound field of sound from the speakers outside the outlet, and the speakers radiate a sound wave for canceling out operation noise including blower sound of the blower toward the duct-like outlet passage, wherein the each section have a width equal to or smaller than one-half of a wavelength of the sound wave radiated from the speakers.

2. An air conditioner according to claim 1, wherein:

the air flow guide panel is vertically pivotable for opening and closing the outlet, and when the duct-like outlet passage is to be formed so as to be open upward, the air flow guide panel pivots such that one end portion of the air flow guide panel comes closer to a lower surface of the blower passage and that the duct-like outlet passage is formed between a surface of the casting forming an upper surface of the blower passage and the air flow guide panel on a downstream side of the speaker with respect to a blower direction, and is disposed so as to extend the lower surface of the blower passage.

3. An air conditioner according to claim 1, further comprising:

an auxiliary panel disposed so as to extend a lower surface of the blower passage when the duct-like outlet passage is to be formed, wherein the air flow guide panel is vertically pivotable for opening and closing the outlet, and when the duct-like outlet passage is to be formed so as to be open downward, the air flow guide panel pivots such that one end portion of the air flow guide panel comes closer to an upper surface of the blower passage and that the duct-like outlet passage is formed between the auxiliary panel and the air flow guide panel on a downstream side of the speaker with respect to a blower direction, and is disposed so as to extend the upper surface of the blower passage.

4. An air conditioner according to claim 2, wherein a length of the air flow guide panel in the blower direction is larger than a height of the outlet at a position at which the speaker is installed.

5. An air conditioner according to claim 3, wherein a length of the air flow guide panel in the blower direction is larger than a height of the outlet at a position at which the speaker is installed.

6. An air conditioner according to claim 1, further comprising:

an auxiliary panel disposed so as to extend a lower surface of the blower passage when the duct-like outlet passage is to be formed, wherein when the duct-like outlet passage is to be formed so as to be open downward, the air flow guide panel pivots such that another end portion of the air flow guide panel comes closer to the upper surface of the blower passage and that the duct-like outlet passage is formed between the auxiliary panel and the air flow guide panel on a downstream side of the speaker with respect to the blower direction, and is disposed so as to extend the upper surface of the blower passage.

* * * * *